US012110770B2

(12) United States Patent
Blois et al.

(10) Patent No.: US 12,110,770 B2
(45) Date of Patent: Oct. 8, 2024

(54) SINGLE OR MULTI-FIRE SEMI-AUTOMATIC PERFORATION SYSTEM AND METHODS OF USE

(71) Applicant: Defiant Engineering, LLC, Houston, TX (US)

(72) Inventors: Stanley Jon Blois, Alberta (CA); Lawrence Gene Griffin, Morrison, CO (US); Ian Graham Janke, Alberta (CA); Cullen Craig Keyes, Hysham, MT (US)

(73) Assignee: Defiant Engineering, LLC, Houston, TX (US)

( * ) Notice: Subject to any disclaimer, the term of this patent is extended or adjusted under 35 U.S.C. 154(b) by 0 days.

(21) Appl. No.: 18/504,456

(22) Filed: Nov. 8, 2023

(65) Prior Publication Data

US 2024/0076967 A1 Mar. 7, 2024

Related U.S. Application Data

(63) Continuation of application No. 18/302,628, filed on Apr. 18, 2023, now Pat. No. 11,846,164.

(60) Provisional application No. 63/363,794, filed on Apr. 28, 2022.

(51) Int. Cl.
*E21B 43/119* (2006.01)
*F42D 1/05* (2006.01)

(52) U.S. Cl.
CPC ..... *E21B 43/119* (2013.01); *F42D 1/05* (2013.01)

(58) Field of Classification Search
CPC ..... E21B 43/11; E21B 43/112; E21B 43/114; E21B 43/116; E21B 43/117; E21B 43/118; E21B 43/1185; E21B 43/11852; E21B 43/11855; E21B 43/11857; E21B 43/1193; F42D 1/05
USPC ..... 89/1.15
See application file for complete search history.

(56) References Cited

U.S. PATENT DOCUMENTS

| | | | | |
|---|---|---|---|---|
| 3,075,462 | A * | 1/1963 | Adamson, Jr. | E21B 43/117 102/306 |
| 4,158,388 | A * | 6/1979 | Owen | E21B 33/13 166/305.1 |
| 11,753,889 | B1 * | 9/2023 | Eitschberger | E21B 23/0417 166/63 |
| 12,000,267 | B2 * | 6/2024 | Loehken | E21B 43/119 |
| 2001/0050172 | A1 | 12/2001 | Tolman et al. | |
| 2007/0261851 | A1 * | 11/2007 | Surjaatmadja | E21B 23/006 166/308.1 |
| 2008/0128132 | A1 * | 6/2008 | Wilcox | E21B 43/116 166/281 |

(Continued)

OTHER PUBLICATIONS

International Search Report and Written Opinion received for PCT Patent Application No. PCT/US23/19139, mailed on Jul. 20, 2023, 11 pages.

*Primary Examiner* — John Cooper
(74) *Attorney, Agent, or Firm* — Workman Nydegger

(57) ABSTRACT

In one example, a method includes running a downhole system into a downhole environment that comprises a wellbore, and the downhole system is configured such that a reusable plug of the downhole system is positioned uphole of a perforation gun of the downhole system, then, with the perforation gun, perforating a casing at a stage of the wellbore, and the perforating is performed using a projectile, and the perforating is performed by firing the projectile from a chamber of the perforation gun.

32 Claims, 27 Drawing Sheets

(56) References Cited

U.S. PATENT DOCUMENTS

| | | | |
|---|---|---|---|
| 2013/0340599 | A1 | 12/2013 | Parrott et al. |
| 2019/0353013 | A1 | 11/2019 | Sokolove et al. |
| 2019/0366272 | A1 | 12/2019 | Eitschberger et al. |
| 2020/0157905 | A1 | 5/2020 | Massey et al. |
| 2021/0123335 | A1 | 4/2021 | Jabari et al. |

* cited by examiner

Notes:

1 - The Safety Blank must be discharged before any other perforation bullets can be fired.

2 - The Physical Safety must be closed before any charges can be fired or the controller can communicate.

3 - The DE Tool Backbone is used on all DE tools.

PERFORATION SYSTEM - COMMANDS

System Status

These are status messages that may be automatically sent by each perf system device each second. The status messages may be available to all perf system devices on a DE CAN Backbone.

DEVICE STATUS

DEVICE STATUS

CAN ID: TBD

Each device on the DE Backbone CAN bus provides status updates each second. For the perforation system device, these are automatic and provide feedback as to the device status after control action commands issued.

Setup Commands

These commands are used one time for each device setup.

SET PERF DEVICE SERIAL ID

QUERY DEVICE SEND DEVICE SERIAL ID

⇩

REPLY DEVICE ACKNOWLEDGEMENT

CAN ID: TBD

Note: Only one device on bus to set Serial ID. Serial ID is a single precision integer (1 to 65535) selected by the UI. Serial IDs must be unique. If duplicate CAN or perf device numbers are on the same CAN bus, bus errors may result.

The perf device will provide a confirmation of the ID assignment.

FIG. 16A

----------Device Commands----------

The device commands are specific operation commands which instruct perf system devices to take a specific control action. Each perforation system device bears a unique Serial ID which must match the command issued before a control action can be taken.

QUERY STATUS

QUERY STATUS

⇩

REPLY STATUS

CAN ID: TBD

Note: Perf device is queried with Serial ID. The device queried replies confirming its ID and the status of the device, i.e., "Standby" or "Armed", etc.

ARM PERF SYSTEM

ARM PERF

⇩

REPLY STATUS

CAN ID: TBD

Note: Perf device command is to ARM. This will allow the Blank charge to be discharged. If the blank has already been discharged, and while at down hole pressure, then this will allow a perforation projectile to be discharged.

The perf device reply confirms status with ID as ARMED.

When the device is ARMED and the blank has not been discharged, the warning light will blink slowly. The warning light will blink rapidly if the blank has already been discharged indicating that the perforation projectiles are able to be fired.

FIG. 16B

FIRE BLANK

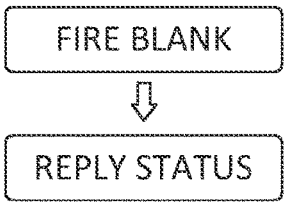

CAN ID: TBD

Note: If the perf device is armed and while at down hole pressure, this will allow the discharge of the blank. Discharge of the blank is confirmed by checking the status of the blank discharged input, this input provides physical feed back.

Firing the blank gives a permissive to proceed with firing the remaining perforation projectiles. The fired blank is a visual indication that the remaining projectile charges are live.

The reply confirms the blank was fired with the ID.

FIRE NEXT PERF

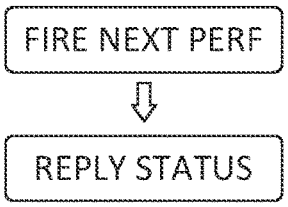

CAN ID: TBD

Note: If the perf device is armed and the blank has been discharged, this will allow the discharge of the next perforation projectile. The order is from the lowest number undischarged position. There is no physical confirmation that this discharge has been made.

The reply confirms the charge was fired with the ID.

FIRE PERF

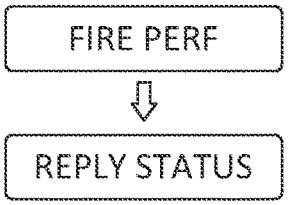

CAN ID: TBD

Note: If the perf device is armed and the blank has been discharged, this will allow the discharge of a specific perforation projectile. There is no physical confirmation that this discharge has been made.

The reply confirms the charge was fired with the ID.

DISARM

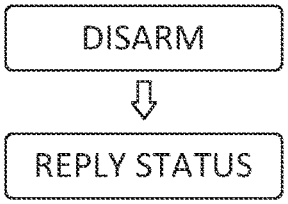

CAN ID: TBD

Note: The DISARM command causes the perf device switching unit power supply fuse to be blown, making the perf device unable to discharge any remaining charges. This action causes a physical break in the electrical circuit and is permanent and not reversable.

DISARM will cause the warning light to provide a brief blink followed by a long interval to indicate the device is disarmed.

Before handling the device the safety disconnects should both be opened (removed).

FIG. 16C

SECTION

SINGLE OR MULTI-FIRE SEMI-AUTOMATIC PERFORATION SYSTEM AND METHODS OF USE

FIELD OF THE INVENTION

One embodiment of the invention is generally directed to downhole systems and equipment such as may be employed in oil and gas exploration, and production. One particular example embodiment comprises a semi-automatic perforation system configured for single-fire, or multi-fire, operations in a downhole environment.

BACKGROUND

Perforation guns are used in downhole environments to fracture a formation so as to enable the injection of pressurized fluid into the formation which will then force gas, oil, and other materials out of the formation. These materials may then be collected. A perforation, or 'perf,' gun may fracture the formation using shape charges. Once the perf gun has fired all its shape charges, the perf gun is then completely retracted out of the wellbore. At this stage, the perf gun is no longer useable and may be recycled or otherwise disposed of.

Once the perf gun starts to fire the shape charges, the perf gun may lose electrical and/or command access through the section of the tool, that is, the perf gun, that fired the charges. Any tools below, or downhole of, the fired shape charge may likewise lose power and communication with the surface.

Many wells for which hydraulic fracturing will be performed will require more than one perf gun per frac. The number of perf guns needed may vary, but a typical oil and gas well may require anywhere from about 30 to 100 fracturing stages, each of which requires a respective perf gun. Thus, conventional approaches to hydraulic fracturing are time consuming at least insofar as perf guns have to be sent downhole, and then retrieved, for each stage of the well. Moreover, because the perf guns are a consumable item and must be replaced after a fracturing operation has been performed for a stage, the use of conventional perf guns is expensive.

Aspects of Some Example Embodiments

One embodiment of the invention is concerned with a downhole system that includes a housing configured to be releasably connected to a tether, projectile fire control circuitry disposed within the housing, a block chamber connected to the housing, and the block chamber includes one or more reloadable chambers each configured to be loaded with a respective projectile, and a firing system operable to directly, or indirectly, control the firing of a projectile, in response to a command issued by the projectile fire control circuitry.

As will be apparent from this disclosure, example embodiments of the invention may be advantageous in various respects. For example, an embodiment may avoid the need to send and retrieve multiple frac guns in order to perform all the stages of a frac. An embodiment may operate to frac a well more quickly than an approach that requires multiple frac guns. An embodiment may enable a frac to be performed less expensively as compared with conventional approaches. Various other advantages of some embodiments of the invention will be apparent from this disclosure.

It should be noted that nothing herein should be construed as constituting an essential or indispensable element of any invention or embodiment. Rather, and as the person of ordinary skill in the art will readily appreciate, various aspects of the disclosed embodiments may be combined in a variety of ways so as to define yet further embodiments. Such further embodiments are considered as being within the scope of this disclosure. As well, none of the embodiments embraced within the scope of this disclosure should be construed as resolving, or being limited to the resolution of, any particular problem(s). Nor should such embodiments be construed to implement, or be limited to implementation of, any particular effect(s).

BRIEF DESCRIPTION OF THE DRAWINGS

The appended drawings contain figures of various example embodiments to further illustrate and clarify the above and other aspects of example embodiments of the invention. It will be appreciated that these drawings depict only example embodiments of the invention and are not intended to limit its scope. Example embodiments of the invention will be described and explained with additional specificity and detail through the use of the accompanying drawings.

FIGS. 16*a*, 16*b*, and 16*c* disclose various example commands that may be generated, transmitted, and/or received, using the electrical block diagram disclosed in FIG. 16.

DETAILED DESCRIPTION OF SOME EXAMPLE EMBODIMENTS

Figure 1:
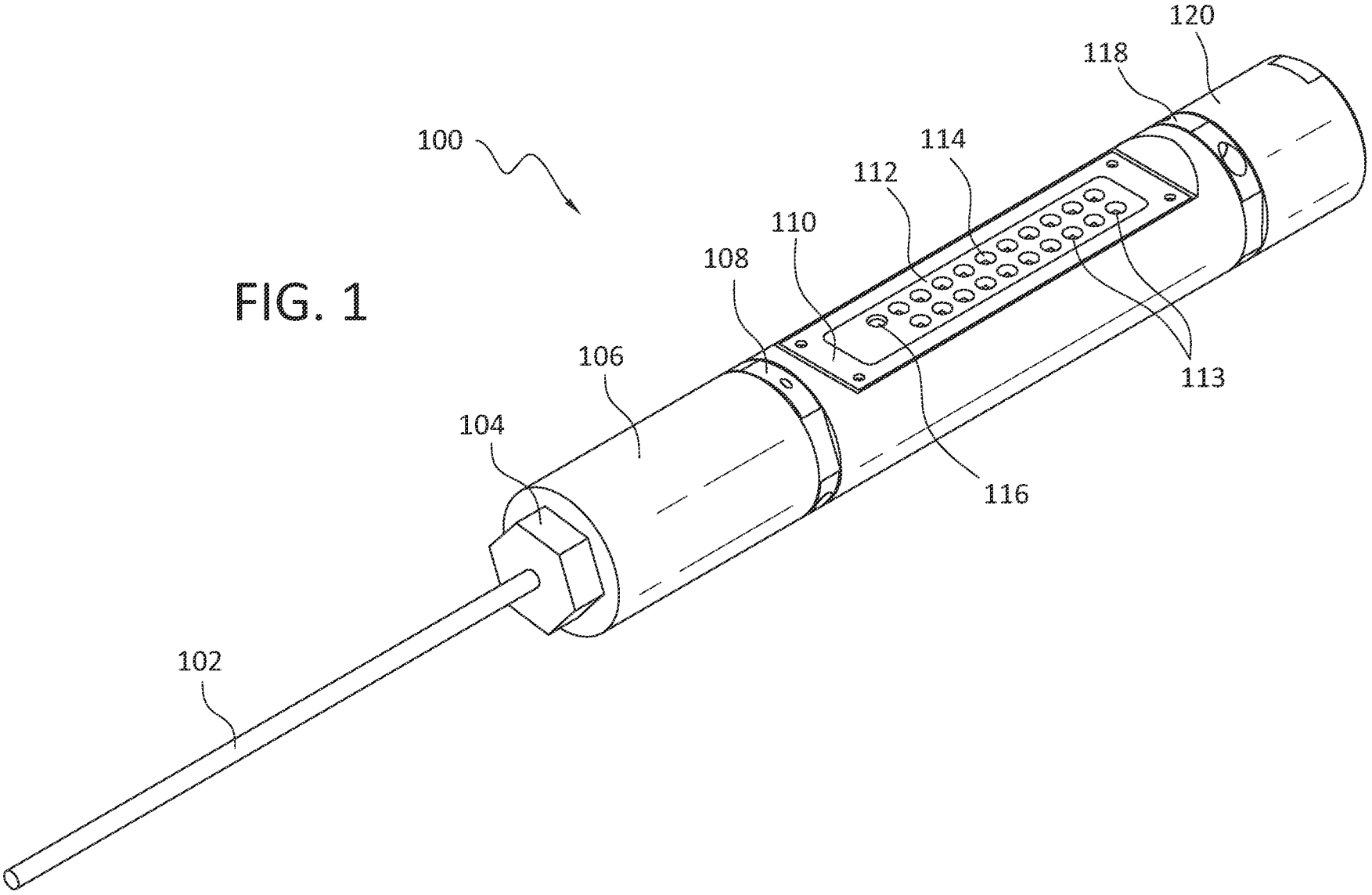
FIG. 1 is an isometric view of a system according to one embodiment.

Details are now provided concerning aspects of example embodiments of the invention, and associated operating environments. Such embodiments may be employed in connection with downhole exploration and mining processes including, but not limited to, gas and oil exploration and mining. The scope of the invention is not limited to any particular application or use case however.

A. CONTEXT—UPSTREAM OIL AND GAS

In an oil/gas exploration/production context, various processes and operations may need to be performed before the actual production of oil, gas, and/or other materials, can take place. Many of such processes and operations may be implemented upstream, that is, upstream of a well head, or other delivery point, of a fossil fuel production system. Some of these processes and operations are discussed in more detail below.

A.1 Drilling a Well

The first process that may take place is the drilling of a well. The drilling operation may comprise a rig drilling a vertical and or horizontal wellbore that may be deep below the surface of the earth. Once the wellbore is drilled, the rig may run multiple sections of casing, or pipe, that may protect the wellbore from collapsing, protect other formations from contaminant, allow for completions, and/or remedial work to take place inside the well later. Once the rig has run casing to the bottom of the wellbore, cement is pumped and fills the void between the casing and the borehole, that is, the wellbore, from the bottom of the well to the surface. Once the wellbore is cased and cemented in place, the well is ready for a frac'ing process.

A.2 Frac and Completion of the Well

After the wellbore is cased and cemented, the next process to take place is frac'ing the well. Frac'ing is a process that may comprise pumping large amounts of water and sand down the well, thereby pressurizing the formation and creating a fracture by way of which oil and gas in the formation can enter the wellbore. This frac'ing process may involve a variety of operations, which are denoted as 'steps' in the following discussion, as well as support equipment and materials at the surface.

Step 1—Plug and Perf

An apparatus operable to perform a plug and perf process may comprise a perf gun, a setting tool, and a plug, all of which may be configured and assembled in a single assembly. The perf gun may comprise a metal tubular tool that includes a number of shape charges that may be rigidly positioned, within the perf gun, to fire in more than one direction. In the case of conventional processes and conventional equipment, the perf gun may not be used more than one time and, as such, may be a consumable item, that is, a single use tool. The plug may be a dissolvable composite, metal, or non-dissolvable composite that serves to create a seal, or barrier, in the wellbore, so that material in the wellbore cannot flow past the plug. The setting tool may comprise an explosive device that is positioned between the perf gun and the plug. The setting tool is used to set the plug and allow the perf gun and setting tool to come off the plug once the plug is set in the wellbore.

This apparatus, that is, the apparatus that includes the perf gun, setting tool, and plug, is then connected to wireline. Once connected to wireline, the apparatus may be staged inside the wellhead and then pumped down the wellbore to a predetermined location. Once the apparatus reaches the predetermined location in the wellbore, the setting tool is activated by a command from the surface sent down the wireline. Once activated, the setting tool sets the plug in the wellbore. Wireline then may start firing the shape charges in the perf gun while the remainder of the apparatus, that is, the perf gun and setting tool, is being retracted back up the wellbore, or 'uphole.' This new section of perforated casing may be called a stage.

Once the perf gun starts to fire the shape charges, the perf gun may lose electrical and/or command access through that section of tool or any tool below the fired shape charge. Once the perf gun has fired all its shape charges, the perf gun is then completely retracted out of the wellbore. At this stage, the perf gun is no longer useable and may be recycled or otherwise disposed of. As noted herein, many wells that require hydraulic fracturing will require more than one perf gun per frac. After the plug and perf operations are completed, the next step of the frac and completion process may be implemented.

Step 2—Fracture the Formation

After the wellbore is perforated at step 1, the well may then be frac'd. To frac a well, a variety of equipment and material is required to operate at the surface. The equipment may comprise, but is not limited to, high-pressure pumps, a blender to mix sand, chemicals, and water, sand trucks, water tanks, a data/command vehicle, a crane, a wireline vehicle, and a large manifold to connect piping and equipment to the wellhead. The material required to fracture the well may comprise, but is not limited to, a combination of water, sand, and chemicals. A number of individuals are also required to operate all the equipment at the surface.

To frac the well now that it is perforated, water, sand, and chemicals are pumped down the wellbore at high rates until those materials reach the plug that has created a barrier in the wellbore. The water, sand, and chemical, with nowhere to go, is forced into the perforations created by the perf gun/shape charges. As the pressure builds up inside the wellbore and perforations, the formation then fractures, and sand and water now enter the fractures. The sand is used to hold the fractures open so that gas, oil, and other materials can be forced out of the formation and into the well. Note that not all perforations created during the perforation process may fracture. In some cases, it may be typical that only 75% or fewer of the perforations created in a given stage may fracture.

Step 3—Plug and Perf for the Next Well Stage

After the first stage, that is, stage 1, of the wellbore has been frac'd (see Step 2 above), the next step, that is, Step 3, may be to pump a new perf gun assembly with a new plug, and possibly a new setting tool, down the wellbore. The assembly may be pumped down the wellbore until it reaches the first set of perforations and cannot go any further. The assembly may then be pulled up to a predetermined location in the well and then set its plug and begin firing the shape charges until all shape charges are fired, after which the assembly may then be pulled out of the hole by wireline. This second stage of the well may then be frac'd. These operations may continue until the wellbore is completely perforated and frac'd.

B. GENERAL ASPECTS OF SOME EXAMPLE EMBODIMENTS OF THE INVENTION

An embodiment of the invention may include, but is not limited to, a reusable perforating system that may be configured and operable for multiple uses, and which is not destroyed after firing its bullets, or projectiles. Because the perf system may be reusable, an embodiment may avoid the accumulation, in the wellbore, of debris that is typically associated with single use perf guns that have been destroyed.

That is, and in contrast with conventional equipment and methods, the perf system and one or more of its individual components, according to one or more embodiments, may be used for multiple perf operations rather than for only a single operation as in the case of conventional equipment and processes. In an embodiment then, such a perf system, and its components, are thus not consumable items.

Some further example embodiments are directed to, among other things, the systems and equipment listed hereafter.

A perforation system that may use caseless projectiles or bullets that do not require a cartridge or housing.

A perforation system which, when a perf gun is fired, may be reloaded and may not lose power or commands to other parts of the perforation system or additional tools or assemblies that may be assembled with the perforation system.

A perforation system that may be pumped downhole and allow the operator to choose the order in which bullets, or other projectiles, are fired, such as choosing which projectile to fire first, and/or how many perforations to fire per stage, without losing command power/command to the system after firing.

A perforation system that may remain in the wellbore including before, during, and after the frac and maintain a tether to the surface and/or other downhole equipment, or may operate autonomously without losing power or command/electrical signal capabilities throughout the tool or other tools and assemblies attached to the perforation system.

A perforation system which, when employed in some methods, may enable an operator to reduce the amount of water, proppant, and power consumption, needed to perform an otherwise conventional frac and, in turn, may reduce the carbon footprint created during the frac. Note that as used herein, 'proppant' includes, but is not limited to, solid materials, such as sand or man-made ceramic materials which, when pumped into a fracture created by a frac'ing process, server to keep the hydraulic fracture open, during and/or following a frac'ing process.

A perforation system which when employed in some methods, may enable the operator and service companies to eliminate, or significantly reduce, fuel consumption, and provide grid power to, but not limited to, the frac equipment at the surface, wireline, trucks, and other equipment used to frac a well.

A perforation system that may create perforations that significantly reduce the amount of friction needed to be overcome while pumping frac fluid, and in turn thereby reducing the treating pressure requirements at the surface and frac pressure created downhole.

A perforation system which, when assembled with other tools or devices, may eliminate the need for plugs or sleeves and, in turn, may eliminate the need to reenter the wellbore with drilling equipment to mill up, that is, destroy, the plugs, or actuate the sleeves.

C. DETAILED DESCRIPTION OF SOME EXAMPLE EMBODIMENTS OF THE INVENTION

Following is a description of one example embodiment of the invention. This description is provided by way of illustration, and is not intended to limit the scope of the invention in any way.

A single or multi-fire semi-automatic perforation system, or simply 'perf system,' may comprise, in an embodiment, a block chamber that may comprise one or more bullets or projectiles and, but not limited to, propellant or increments for propelling the projectiles. Example bullets, or more generally, 'projectiles,' may be caseless, that is, not housed within, nor includes, a casing. This configuration of projectiles may eliminate the need to eject or discharge a used cartridge or case during operation once the perf system has fired.

The perf system may comprise a block chamber that may house multiple bullets, or other projectiles. In an embodiment, a mix of different projectiles may be contained in the block chamber. The projectiles may be hermetically sealed into the block chamber and be exposed to the wellbore environment. An ignitable material such as a propellant or increment, may be positioned below or behind each of the projectiles. A hermetically sealed electrical, mechanical, or electro-mechanical primer may be positioned so as to ignite the propellant and may be exposed to the wellbore environment after a projectile is fired. The primers may be wired to a perforation detonation controller that may be housed within a board enclosed within the perf system. The board may send signals or commands to a primer to fire a projectile. The perf system comprise a blank to ensure safety. That is, a perf system may be configured such that the blank is fired first, before the rest of the system can be activated, or goes live. The projectiles may be fired in any sequence, with respect to each other, and in an embodiment, two or more projectiles may be fired simultaneously.

An embodiment of the perf system may also comprise a magazine that houses one or more bullets or projectiles. The bullets or projectiles may be automatically loaded into a barrel, or chamber by, for example, a spring or actuation device that pushes the bullets, or projectiles down or up the magazine and into the barrel or chamber. Once the bullet, or projectile, which may comprise a primer, is chambered in the barrel, the projectile may be fired. In an embodiment, firing of the projectile may be initiated by an electrical mechanism, mechanical mechanism, or electro-mechanical system or firing pin, or any other system or mechanism operable to selectively impact the primer so as to cause the primer to ignite the propellant, causing the projectile to be fired. The bullets or projectiles that may be used with the magazine system may also be caseless, that is, not housed within a cartridge that must be ejected or discharged. The caseless configuration may reduce or eliminate any debris or waste that may otherwise be generated during operation of the perf system.

In an embodiment, the caseless bullets, or projectiles, may be incorporated with devices inside of the jacket that enable the projectile to fragment, or explode, sometime during or after impact with the formation. The bullets, or projectiles, may also comprise other devices such as tracers, or smart technology such as nano technology, that may be released from the bullet sometime during impact or after. The bullets, or projectiles, may also be made of a dissolvable material that may dissolve over time after the bullet, or projectile, is fired.

In an embodiment, nano technology may include, but is not limited to, nanobots, nano-technology that may comprise nano tubes configured and operable to deliver high or low frequency precision signals. In an embodiment, the signals may be encoded within the nanotubes, which in turn may enable the nanobots to communicate with other nanobots and/or to transmit any type of information to components such as, but not limited to, a receiver that may be part of the downhole tool assembly.

In an embodiment, a projectile, such as a bullet for example, may house smart nanobots that are released from the bullet once the bullet fragments. The nanobots may comprise polymers, ceramics, and exotic alloys for armor. The nanobots may be lodged in the perforation that has been made when the bullet penetrates the well casing and cement and lodges itself into the formation. After the nanobots have been released, when the formation fractures during the frac, the nanobots may travel throughout the fractures and collectively form a mesh network that may be used to map a formation and communicate information back to the perf gun and/or to an uphole or surface location.

In an embodiment, the perf system may be used downhole in oil and gas operations. When thus employed, the perf system may operate to create perforations in structures including, but not limited to, casing or tubular member inside the wellbore, and geological formations. These perforations may be created, for example, during remedial operations, during a frac, and/or at any other appropriate times.

In an embodiment, a perf system may be housed inside of structures including, but not limited to, a tubular or cylindrical tool, which may be made of metal for example. The tool may comprise a portable control board, or CPU (central processing unit), to command or electrically control the perf system. The CPU may be controlled, such as by a user at the surface, by a master control unit that delivers commands through, for example, an i2c or CAN bus system. Electrical switches or connectors may be used on either end of the perf system to pass controls throughout the system and/or to other tools or devices that may be assembled together with the perf system.

In an embodiment, a perf system may be run in the wellbore with multiple tools assembled to it such as, but not limited to, optical systems, sealing systems, tractors or other propulsion devices, logging systems or devices, or any tool or device chosen by an operator to run in conjunction with the perf system. The perf system may be powered by various power sources including, but not limited to, batteries for autonomous operations in the wellbore when the perf system is not tethered to power at the surface. The perf system may also be tethered to a power source located at the surface, which in turn, may continue to supply power to the perf system or other tools that may be connected or assembled with the perf system. The perf system may also be run with, but not limited to, coiled tubing or stick pipe run by a rig at the surface. In an embodiment, a perf system may also remain in the wellbore before, during, and after the frac, and the perf system may remain mechanically and electrically operable before, during, and after the frac.

D. DETAILED DESCRIPTION OF THE FIGURES

Turning now to FIGS. 1-31, details are provided concerning some embodiments of the invention. The examples disclosed in the Figures are presented only by way of example, and are not intended to limit the scope of the invention in any way.

D.1—FIG. 1

D.1.1—Tether

FIG. 1 discloses an example perf system 100 according to an embodiment of the invention. The perf system 100 may include a tether 102 which may comprise, but is not limited to, wireline, fiber optic, or e-line connection that may convey power or commands from the surface to the Fury system, and may convey, to the surface, information and data from the Fury system.

D.1.2 Connection

A connection device 104 may comprise a cable head connection which may be coupled to the perf system 100.

D.1.3 Controls Housing

A controls housing 106 may house one or more PCBs (printed circuit boards), master control units, CPUs, and/or modems. A controller stored in the controls housing 106 may receive and send data, or signals, to the perf system or back to the surface during operation. The controls housing 106 may also include, for example, a pressure sensor, temperature, sensors, accelerometers, or an optical device or sensor that may record internal and or external data.

The materials used for manufacturing the controls housing 106 may include, but are not limited to, aluminum, manganese, zinc, or other bronze alloys. Nickel alloys or combinations of, but not limited to nickel with materials such as iron, chromium, copper, or molybdenum. Stainless steel alloys or combinations of, but not limited to nickel, copper, or manganese. Aluminum alloys or combinations of, but not limited to, zinc, copper, or iron. Other materials may also include, but not limited to, iron, titanium, polymers or plastics, carbon fiber, or tin. The controls housing 3 may be made by various processes, including casting, machining from solid material, or 3D printed or manufactured through a process such as additive manufacturing.

D.1.4 Coupling

A coupling 108 may be used to connect the perf system 100 to other tools. The coupling 108 may be threaded.

D.1.5 Retaining Cap

A retaining cap 110 may be used to retain the block chamber within the body of the tool. The retaining cap 110 may also create a seal that may prevent the ingress of wellbore fluid or contaminants into the perf system. This seal may be hermetic, and may comprise a gasket, or a polymer that is compressed between the retaining cap 110 and the tool body.

The material used for manufacturing the retaining cap 110 may comprise aluminum, manganese, zinc, or other bronze alloys. Nickel alloys or combinations of, but not limited to nickel with materials such as iron, chromium, copper, or molybdenum. Stainless steel alloys or combinations of, but not limited to nickel, copper, or manganese. Aluminum alloys or combinations of, but not limited to, zinc, copper, or iron. Other materials may also include, but not limited to, iron, titanium, polymers or plastics, carbon fiber, or tin.

The retaining cap 110 may be made by various processes, including casting, machining from solid material, or 3D printed or manufactured through a process such as additive manufacturing.

D.1.6 Block Chamber

The block chamber 112 may be configured to enable one, or many, bullets, or projectiles 114, and propellant to be stored within one block chamber 112. The block chamber 112 may be configured such that the individual chambers 113 that the bullets, or projectiles 114, are hermetically sealed to, may be angled or straight. The bullet chambers 113 may be arranged in various ways, such as staggered, side-by-side, oriented at different angles around the block chamber 112 to fire in multiple directions such as, but not limited to, 0 degrees, 90 degrees, 180 degrees, and 270 degrees. The block chamber 112 may also comprise one or more firing pins that may be, but not limited to, electric primers, mechanical, or electric mechanical firing pins. The block chamber 112 may also house one or more boards that may send or receive command signals.

The material used for manufacturing the block chamber 112 may comprise, but is not limited to, aluminum, manganese, zinc, or other bronze alloys, nickel alloys, combinations of nickel with materials such as iron, chromium, copper, or molybdenum. Stainless steel alloys or combinations of, but not limited to nickel, copper, or manganese. Aluminum alloys or combinations of, but not limited to, zinc, copper, or iron. Other materials may also include, but are not limited to, iron, titanium, polymers, plastics, carbon fiber, and tin.

The block chamber 112 may, for example, be cast, machined from solid material, or 3D printed or manufactured through a process such as additive manufacturing.

D.1.7 Projectile

A bullet, which is one example of a projectile 114 that may be employed by embodiments of the invention, may be configured in different sizes. Example diameters for a projectile 114 may include, but not are limited to, 0.250" or 0.500". The bullet may be hermetically sealed into the block chamber 112. The projectiles 114 may or may not be caseless, and may or may not be received within a cartridge.

The bullets, or projectiles 114, may also be manufactured to house, within the bullet or projectile 114, devices and elements such as, tracers, smart technology such as nano technology, that is released from the bullet sometime during impact or after. The bullets, or projectiles 114, may also be a dissolvable material that may dissolve over time after the bullet, or projectile 114, is fired.

The material(s) used for manufacturing the projectile 114 may comprise, for example, aluminum, manganese, zinc, or other bronze alloys, nickel alloys or combinations of, but not limited to nickel with materials such as iron, chromium, copper, or molybdenum, stainless steel alloys or combinations of, but not limited to nickel, copper, or manganese, or aluminum alloys or combinations of, but not limited to, zinc, copper, or iron. Other materials may also include, but are not limited to, iron, titanium, polymers or plastics, carbon fiber, or tin. The projectile 7 may also be made with an alloy material, such as a magnesium-based alloy for example, that dissolves over time.

The projectile 114 may be cast, machined from solid material, or 3D printed or manufactured through a process such as additive manufacturing.

D.1.8 Blank Chamber

A blank chamber 116 may comprise a blank 117 (see FIG. 16), or non-projectile firing device. The perf system 100 may not be live, or activated, until the blank 117 in the blank chamber 116 is first ignited, fired, or activated. Activation of the perf system 100 may be performed by devices, such as an accelerometer, that are able to detect that the blank 117 in the blank chamber 116 has been fired. This may help to increase safety efficiency and to prevent activation of the perf system 100 until it is downhole.

D.1.9 Coupling

A coupling 118 may be used to connect the perf system to other tools. The coupling 108 may or may not be a threaded coupling.

D.1.10 Connection Sub

The connection sub 120, which may be threaded or comprise a push-to-unlock connection, may enable the perf system to connect to other tools that are downhole of the perf system.

D.2—FIG. 2

D.2.1—Controls Housing

The controls housing 106 may house one or more of PCBs, master control units, CPUs, or modems. The control board, or boards, stored in the controls housing 106 may receive and send data, and control signals, to the perf system 100 or back to the surface during operation. The controls housing 106 may also house, for example, a pressure sensor, temperature, sensors, accelerometers, or an optical device or sensor that may record internal and or external data.

The material used for manufacturing the controls housing 106 may comprise aluminum, manganese, zinc, or other bronze alloys, nickel alloys or combinations of, but not limited to nickel with materials such as iron, chromium, copper, or molybdenum, stainless steel alloys or combinations of, but not limited to nickel, copper, or manganese, aluminum alloys or combinations of, but not limited to, zinc, copper, or iron, and other materials may also include, but not limited to, iron, titanium, polymers or plastics, carbon fiber, or tin.

The controls housing 106 may be cast, machined from solid material, or 3D printed or manufactured through a process such as additive manufacturing.

D.2.2 Seal

A seal 122 may be incorporated to protect the system from contamination. The seal 122 may be made from various materials such as, but not limited to, polymers, rubber, or plastics.

D.2.3 Coupling

A coupling 108 may be used to connect the perf system to other tools. The coupling 108 may or may not be threaded.

D.2.4 Board Encloser

The board encloser 124 may house, for example, a remote 10 (input/output) interface, or separate control board that may be operable to receive signals from the master control board, and to send signals or commands to the perf system. The control board may comprise multiple signal switches that are wired to their own respective firing pin, or ignition switch. The control board may receive a signal or command from the master control board that may command the perf system to fire one, or more, bullets, or other projectiles. The board may be potted, or protected, with a coating to protect the board from, but not limited to, shock, vibration, contaminants, or high temperature and pressure.

D.2.5 Blank Chamber

The blank chamber 116 may be configured to hold a blank 117 (see FIG. 16), or non-projectile firing device. The perf system 100 may not be live, or activated, until a propellant in the blank chamber 116 is first ignited, fired, or activated. Activation of the perf system 100 may be performed by devices, such as an accelerometer, that are able to detect that the blank 117 in the blank chamber 116 has been fired. This system may be employed to increase safety, efficiency, and to prevent activation of the perf system 100 until it is downhole.

D.2.6 Projectile

A block chamber 112 may be configured to accommodate bullets 114, or other projectiles, of various sizes, such as, but not limited to, projectiles having a diameter within a range of about 0.250" or 0.500." The projectile 114 may or may not be hermetically sealed into the block chamber. The projectiles 114 may or may not be caseless, that is, not stored within, or connected to, a cartridge.

The projectiles 114 may also be manufactured to house, or contain, within the projectile 114, components including, but not limited to, tracers, or smart technology such as nano technology, that is released from the projectile 114 sometime during impact or after. The projectiles 114 may also be a dissolvable material, such as but not limited to, magnesium-based alloys that may dissolve over time after the projectile, or projectile, is fired.

The material used for manufacturing the projectile 114 may be, but not limited to aluminum, manganese, zinc, or other bronze alloys, nickel alloys or combinations of, but not limited to nickel with materials such as iron, chromium, copper, or molybdenum, stainless steel alloys or combinations of materials such as, but not limited to, nickel, copper, or manganese, aluminum alloys or combinations of, but not limited to, zinc, copper, or iron, and other materials may also include, but not limited to, iron, titanium, polymers or plastics, carbon fiber, or tin. The projectile 114 may also be made with an alloy material that dissolves over time.

The projectile 114 may be cast, machined from solid material, or 3D printed or manufactured through a process such as additive manufacturing.

D.2.7 Propellant

The propellant 126 may comprise a source, or substance, that may be ignited and, after ignition, propel the projectile 114. The propellant 126 may comprise, for example, a powder or grain of various sizes that may be made up of potassium nitrate, sulfur, and charcoal. The propellant 7 may also be made of, but not limited to, nitroglycerin, nitrocellulose, nitroguanidine, ammonium nitrate, ammonium dinitramide, or a combination of other highly explosive substances. The substance used in the propellant 126 may also be oxidizable, and may produce various quantities and types of high pressure gas(es) that will propel the projectile 114 out of the block chamber 112. The propellant 126 may be ignited, or activated, by electrical connection, mechanical, or electrical/mechanical connection.

D.2.8 Firing and Ignition Pin/Primer

The primer 128 may comprise, for example, a resistance filament that may allow a specified current, at a predetermined voltage, to travel through the primer 128. Passage of the current, which may result from a voltage differential across the filament may cause the propellant 126 to be ignited or activated. The primer 128 may also extend up into the propellant 126 chamber so that the propellant 126 surrounds the primer 128. The primer 128 may be hermetically sealed into the block chamber 112. The seal may be maintained after the perf system 100 fires, ensuring that no leak paths are created past the propellant 126 chamber after firing. The seal may be a metal-to-metal bond, epoxy bond, or ceramic, elastomer or polymer, or glass seal that is between the primer 128 and the block chamber 112. The primer 128 may be installed into the perf system 100 by an interference fit, compression fit, or threaded into the block chamber 112, for example.

D.2.9 Wire and Command Pathway

The wire and command pathway 130 may be positioned below the primers 128. This arrangement may enable the command wires to travel from the board encloser 124 to the primers. The main backbone cables and commands (see FIG. 1/6), but not limited to, CAN bus or i2c may also run through the wire and command pathway 130.

D.3—FIG. 3

D.3.1 Electrical Connector

A, electrical connector 132 may be connected to a board, or boards, that send commands to the perf system 100, or other tools in the assembly. The electrical connector 132 may be threaded into the system, locked, or pinned into the body, or hermetically sealed. The electrical connector 132 may be rated for high temperature and high pressures, such as but not limited to, high pressures up to about 20,000 psi and high temperatures up to about 250 Celsius.

D.3.2 Backbone Pathway

The backbone pathway 134 may enable command wires or cables, or other devices, to travel through the system and enable command access throughout the perf system 100.

D.3.3 Hydraulic Pathway or Pressure Chamber

A pressure chamber 136 may be filled with an oil, or fluid, and thus act as a pressurization system, and/or for cooling the system down during operation. In this way, the entire perf system 100 may be filled with oil, or another fluid, which may equalize the internal pressure in the perf system 100 relative to the external pressure in an environment such as a well bore, or at least reduce a pressure differential between the two.

D.3.4 Accumulator and Compensator

A compensator 138 may be a honed, or machined, orifice or cylinder that may be filled with oil, or a fluid, that is pressurized by external pressure acting on a sealed hydraulic puck, or piston. External pressure may enter the pressure chamber 136 and act on a piston so as to cause the piston to move and pressurize the internal body and equalizing the internal pressure in the perf system 100 with the pressure in the wellbore.

D.3.5 Electrical Connector

An electrical connector 140 may be connected to the backbone and to the board enclosed in the perf system 100 block chamber 112. This electrical connector 140 may enable commands to be sent to other assemblies within the system. The electrical connector 140 may be threaded into the system, locked, or pinned into the body, or hermetically sealed. The electrical connector 140 may be rated for high temperature and high pressures.

D.4—FIG. 4

Figure 4:
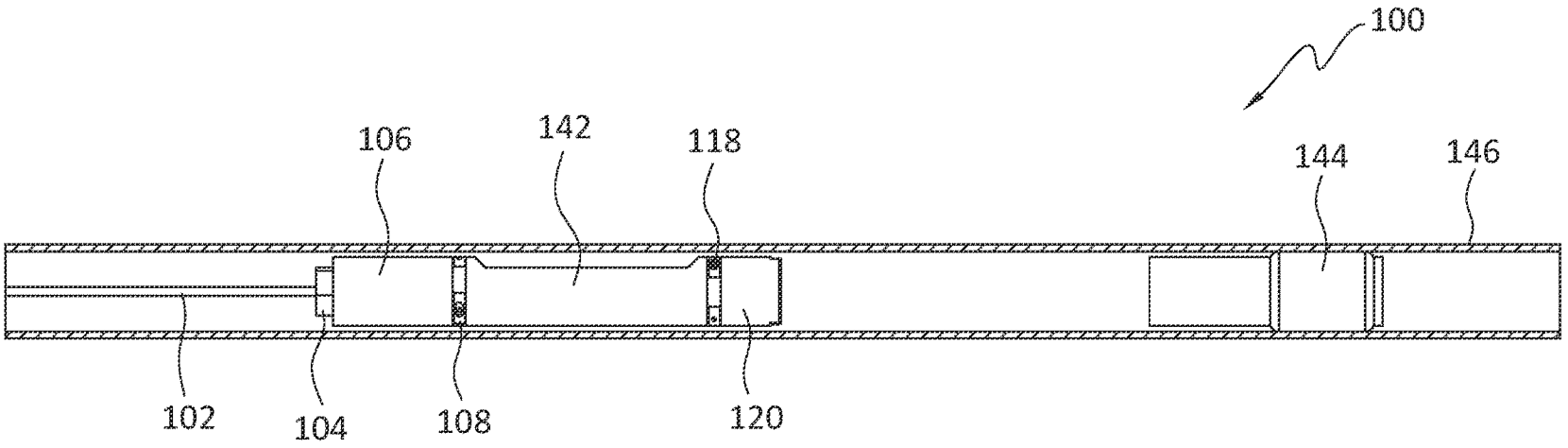
FIG. 4 is a side view of a perf system.

FIG. 4 discloses an example perf system 100 configuration that may be pumped down with or without a plug or packer assembly that may be attached to the perf system 100 that may be released, or placed, in the wellbore during operations such as a frac'ing operation, for example. The example perf system 100 configuration in FIG. 4 may be assembled and deployed as follows: [1] assemble the perf system 100 at the surface to accommodate a plug, packer, or other devices or tools that may be needed during the frac'ing operation; [2] place the perf system, and assemblies, in the lubricator. Pump the perf system 100 down the wellbore to a predetermined location in the wellbore; and [3] once the predetermined location is reached, where the predetermined location may be chosen by an operator, or where an existing plug, packer, or other device, in the wellbore is located, the perf system will reach the device, plug, or packer. Note that if a packer, plug, or other device, is connected or assembled to the perf system, the predetermined location will be an area in the wellbore where the plug, packer, or device will be released from the perf system and placed, or set, in the wellbore.

Following are some example configurations/deployments of the perf system and associated components: [1] perf system tethered to wireline, collectively denoted at 142—the perf system 100 may be tethered to wireline and pumped down the wellbore with high or low-rate fluid and or be pulled up the wellbore by the tethered wireline connection; [2] plug 144—a plug 144 may be used to seal the wellbore so that fluid is prevented from passing the section of the wellbore that the plug 144 is set in; and [3] wellbore casing 146 or other tubular member—the wellbore casing 146 may be a steel, or alloy, pipe that is installed in the wellbore and cemented in place.

D.5—FIG. 5

Figure 5:
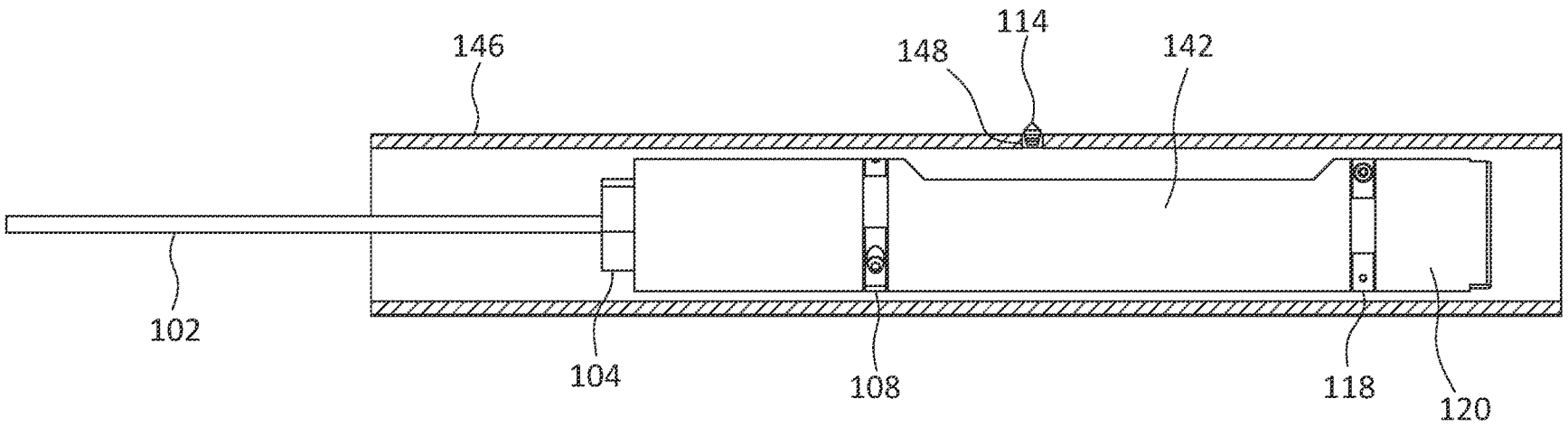
FIG. 5 is a side view of a perf system.

FIG. 5 shows an example embodiment of the perf system 100 firing one bullet 114, or projectile, into the casing 146 so as to create a perforation. This may comprise the following operations: [1] send, from a surface location or elsewhere, a command to the perf system 100 to 'FIRE' to cause the firing of one or more projectiles 114, such as bullets, into the casing 146. In an embodiment, a command to 'FIRE' may be received by the master controller. The master controller may then send a signal, corresponding to the 'FIRE' command, to the board inside the board encloser 124 (see FIG. 2) within the block chamber 112 (see FIG. 2), which then results in the firing of the projectile 114; [2] the board housed within the board encloser 124 sends a signal to the predetermined bullet or projectile 114 to fire, and the propellant 126 is ignited, or activated by the primer 128 (see FIG. 2), propelling the bullet 114 into the casing and so that the bullet 114 creates a perforation 148 in the wellbore casing 146; [3] pull the perf system 100 out of the hole.

D.6—FIG. 6

Figure 6:
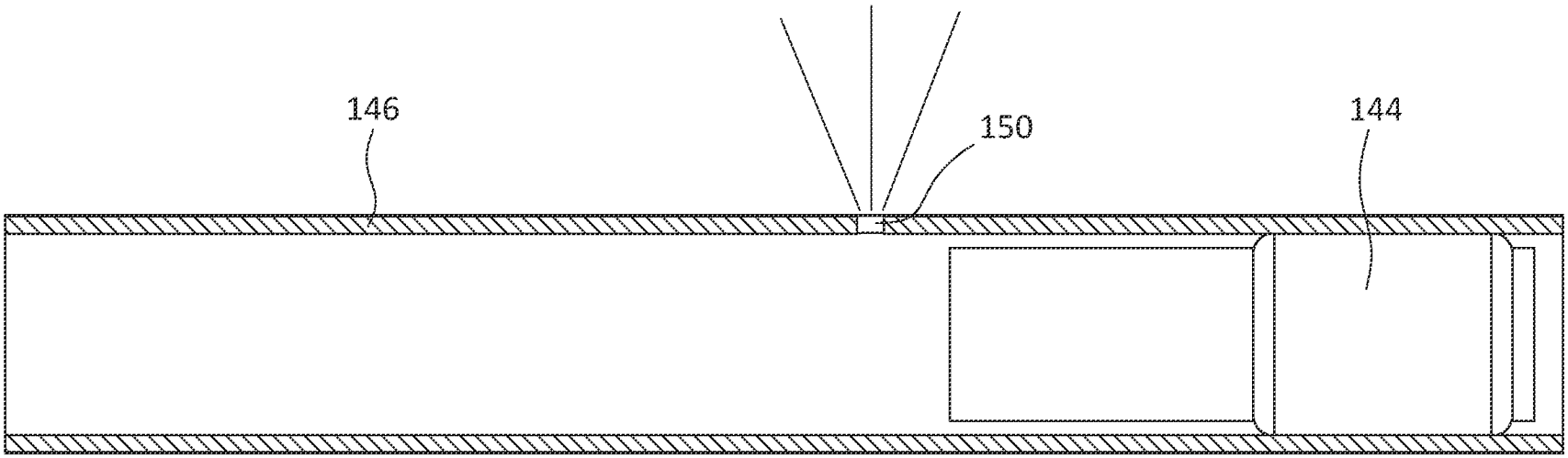
FIG. 6 is a stylized view of a perf system firing a projectile. This only shows a hole and the plug; not firing a projectile?

FIG. 6 shows an example of a perforation 150 that was made, in front of the plug 144 in this example, by an example embodiment of the perf system 100. The frac may be done using high, or low, fluid flow rate fluid mixtures being pumped against the plug 144, for example, and the mixtures are forced into the perforation 150 until the frac pressure is reached for the rock formation and a fracture is created.

D.7—FIG. 7

Figure 7:
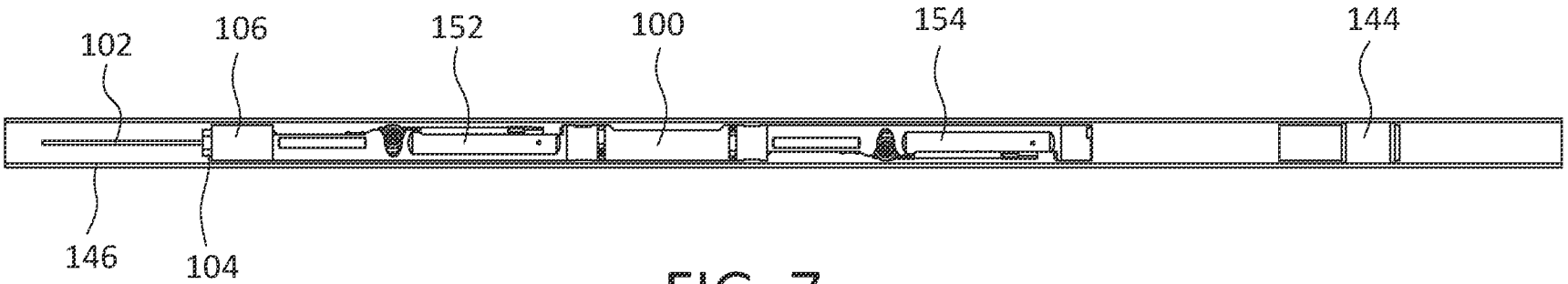
FIG. 7 is a cutaway view of a perf system indicating various components.

FIG. 7 discloses an example configuration of a perf system 100 assembled with a tractor, or propulsion device, that may be used to push and or pull the perf system around during operations, such as a frac'ing operation. The example configuration disclosed in FIG. 7 may be assembled as follows: [1] assemble the perf system 100 with 1 or more tractors and, a plug, packer, or other device or tools that may be needed during the frac'ing operation; [2] insert, or place, the perf system, and accommodating assemblies, in the lubricator, and pump the perf system 100 down the well to a predetermined location in the wellbore, or to an area where pumping may no longer force the assembly further down the wellbore; [3] when the perf system 100 has reached the predetermined location, and cannot be pumped any further down the wellbore, a tractor assembly, or other propulsion devices, may be activated by a command signal sent from the surface. Once activated, the tractor, or propulsion device, may propel or move the perf system 100 and accommodating tools or assemblies to the predetermined location in the wellbore casing 146; [4] release the plug, or packer, in the wellbore; and [5] deactivate the tractor or propulsion device—note that this operation may be omitted if the operator chooses to continue propelling the perf system with the existing tractor or propulsion device.

With continued reference to FIG. 7, following are some example configurations/deployments of a perf system and associated components:

[1] Tether—Connection—Controls Housing

The tether 102 described in FIG. 7 may comprise, for example, a wireline, fiber optic, or e-line connection that may send power or commands back and forth between the surface and the perf system. The connection device 104 may comprise, for example, a cable head connection which may be coupled to the perf system. Finally, the controls housing 106 may house one or more, but not limited to, PCBs, master control units, CPUs, and modems. The control board in the controls housing 106 may receive/send data and information between the perf system and the surface during operation.

The controls housing 106 may also hold a pressure sensor, temperature, sensors, accelerometers, or an optical device or sensor that may record internal and or external data.

The material used for manufacturing the controls housing may be, but not limited to aluminum, manganese, zinc, or other bronze alloys. Nickel alloys or combinations of, but not limited to nickel with materials such as iron, chromium, copper, or molybdenum. Stainless steel alloys or combinations of, but not limited to nickel, copper, or manganese. Aluminum alloys or combinations of, but not limited to, zinc, copper, or iron. Other materials may also include, but not limited to, iron, titanium, polymers or plastics, carbon fiber, or tin.

Finally, the controls housing may be made from, but not limited to, cast, machined from solid material, or 3D printed or manufactured through a process such as additive manufacturing.

[2] Tractor or Propulsion Device

A tractor 152 may comprise, for example, a mechanical, electrical, or hydraulic driven or propulsion unit used to move different tools or assemblies around in the wellbore. This tractor 152 may be used, for example, to push the perf system around in a downhole environment.

[3] Perf System

The perf system 100 may be assembled together, possibly releasably, with the tractor 152 and propelled, or moved, around in the wellbore.

[4] Secondary Tractor or Propulsion Device

A secondary tractor 154 may be assembled downhole of the perf system 100 to pull the perf system 100 around in the wellbore. The system is not limited to how many devices, tools, or tractors that may installed with the assembly. For example, such other devices, tools, and/or tractors, may include, but are not limited to, plugs, slips, gamma ray or other logging tools, downhole scanning systems, and imaging tools.

[5] Plug

A plug 144 may be used in some embodiments to seal the wellbore so that fluid and other materials may be prevented from passing into the section of the wellbore that the plug 144 is set in.

D.8—FIG. 8

Figure 8:
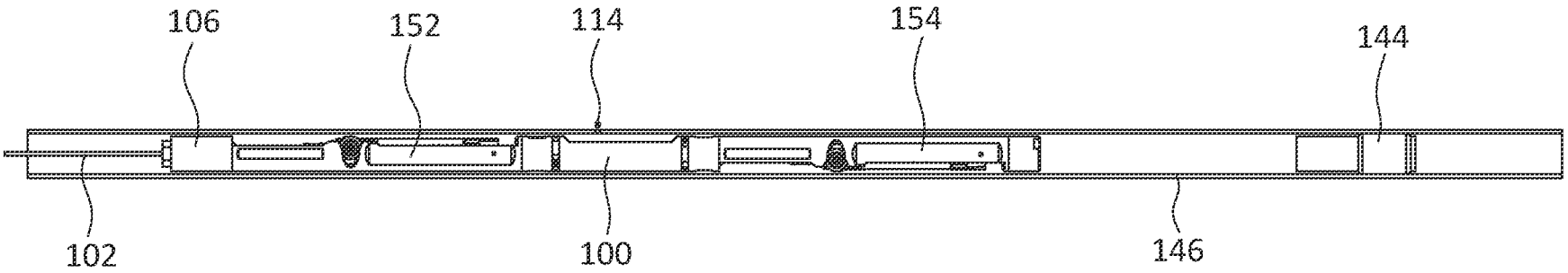
FIG. 8 is another cutaway view of a perf system indicating various components.

FIG. 8 shows an embodiment of the perf 100 system firing a bullet, or projectile 114, into the wellbore casing 146 or other tubular member and creating a perforation. In an embodiment, this process may comprise the following operations: [1] send, from a surface location or elsewhere, a command to the perf system 100 to 'FIRE' to cause the firing of one or more projectiles 114, such as bullets, into the casing 146. In an embodiment, a command to 'FIRE' may be received by the master controller. The master controller may then send a signal, corresponding to the 'FIRE' command, to the board inside the board encloser 124 within the block chamber 112, which then results in the firing of the projectile 114; [2] the board housed within the board encloser 124 sends a signal to the predetermined bullet or projectile 114 to fire, and the propellant 126 is ignited, or activated, by the primer 128, and the projectile 114 is propelled into the casing 146, creating a perforation; and [3] pull the perf system 100 out of the hole.

D.9—FIG. 9

Figure 9:
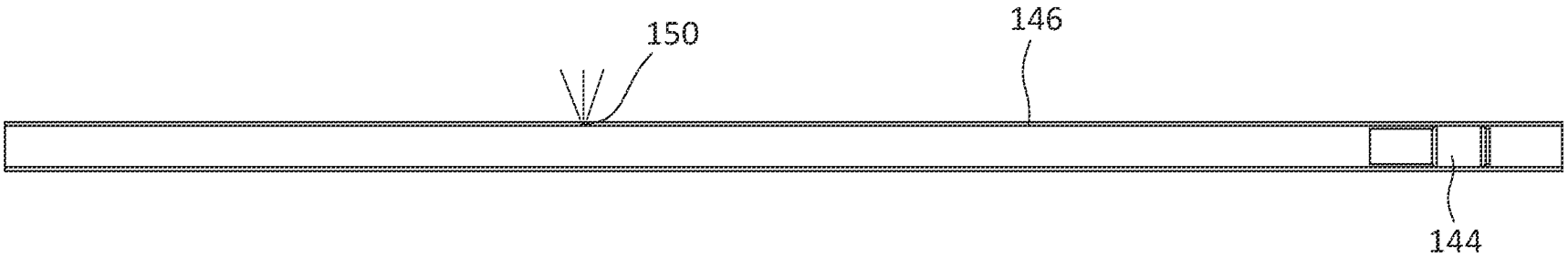
FIG. 9 is a stylized view of a perf system firing a projectile.

FIG. 9 shows a perforation 150 that was made by an example embodiment of the perf system 100 in front of a plug 144. The frac may be done by high or low-rate fluid mixtures being pumped against the plug 144, and forced into the perforation 150 until the frac pressure is reached for the rock formation and fracture is created.

D.10—FIG. 10

Figure 10:
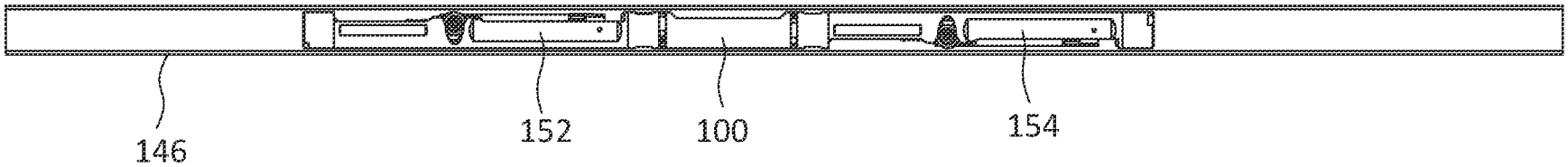
FIG. 10 is another cutaway view of a perf system indicating various components.

FIG. 10 discloses an example configuration of the perf system 100 assembled with a tractor 152/154, or propulsion device, that may be used to push and or pull the perf system 100 around during various operations, such as a frac'ing operation. In some embodiments, the perf system 100 may not be tethered and may be fully independent, autonomous, or self-contained, in terms of its movements and operations.

The master control board may be preprogrammed with a set of coding and commands which, when executed, may cause performance of any or all of the following operations: [1] navigate the wellbore autonomously to different locations within the wellbore during the frac; [2] perforate the wellbore with the perf system 100 at one or more preprogrammed locations—the locations may be located within the system by an onboard encoder, resolver, or a combination of these; [3] create a seal and hold in place during the frac.

Preparation and placement of the perf system 100 in one or more locations in a downhole environment may comprise the following operations: [1] assemble the perf system 100 with one or more tractors 152/154, and device(s) such as a plug, packer, or other device or tools that may be need during the frac'ing operation; [2] place the perf system 100, and associated assemblies, in the lubricator, and pump the perf system 100 down the well to a predetermined location, or locations, in the casing 146 in the wellbore, or to an area where pumping may no longer force the assembly further down the wellbore—note that pump down may only be needed if the perf system 100 is tethered to a wireline for example—if the perf system 100 is tethered and pumped down the wellbore, once the perf system 100 reaches its predetermined location, it may be mechanically, electrically, or electrically mechanically released from the wireline, or tethered system—on the other hand, if the perf system 100 is not tethered, pumped down, and released, it may self-propel itself from the surface to a predetermined location in the wellbore, and power, which may be supplied by a power source, such as a battery, fuel cell, or nuclear power may be required to power the perf system 100.

D.11—FIG. 11

Figure 11:
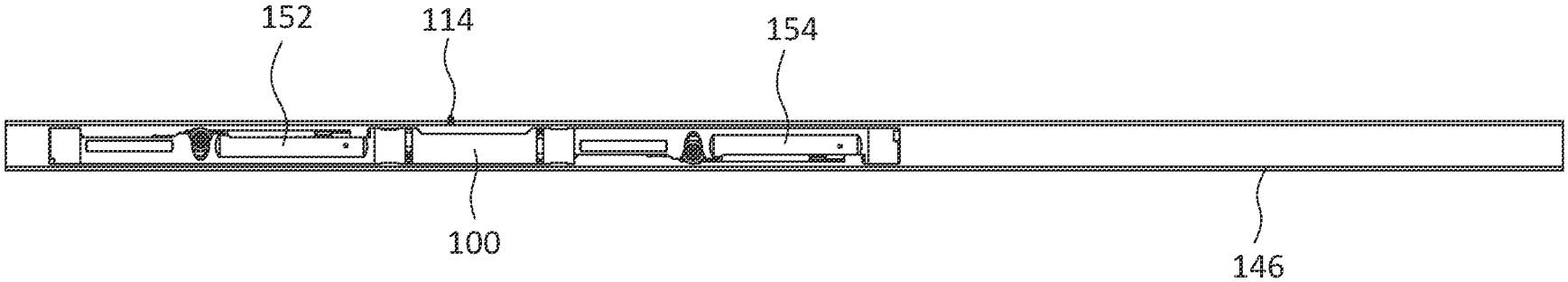
FIG. 11 is another cutaway view of a perf system indicating various components.

FIG. 11 shows an example implementation of an autonomous perf system 100 firing a projectile 114 to create a perforation 150 (see, e.g., FIG. 9) into the wellbore casing 146, or tubular member, and creating a perforation 150 at a predetermined location.

D.12—FIG. 12

Figure 12:
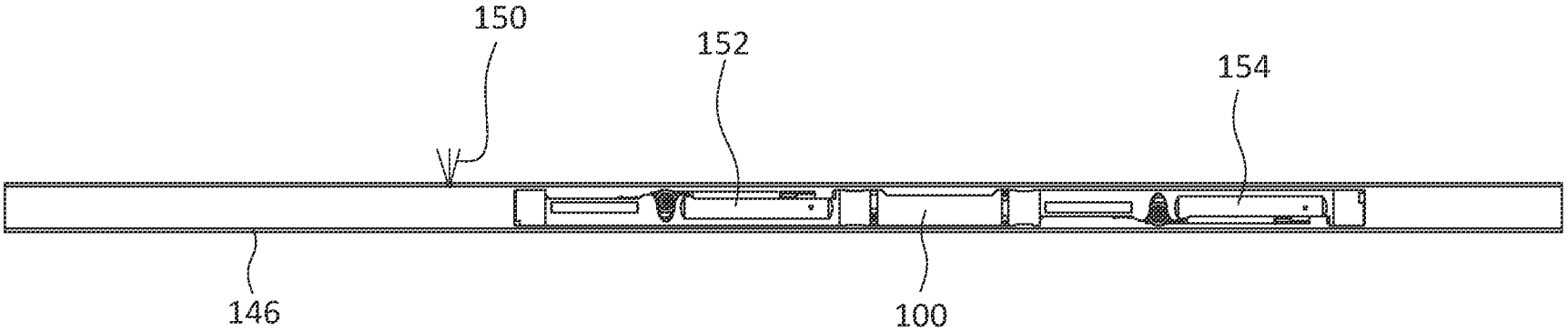
FIG. 12 is a stylized view of a perf system firing a projectile.

FIG. 12 shows the next step of an example autonomous operation where the perf system 100 may relocate below the perforation 150 that was made from the perf system 100 firing its bullet, or projectile, into the casing, or tubular member in the wellbore.

D.13—FIG. 13

Figure 13:
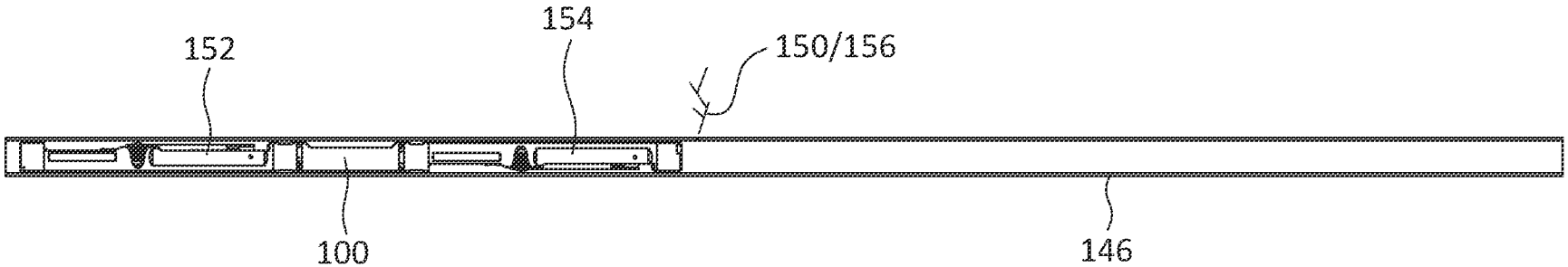
FIG. 13 is a cutaway view of a perf system and a fracture that has been created.

FIG. 13 shows an example embodiment of the perf system 100 self-propelling to the next preprogrammed location in the wellbore, uphole of the previously created perforation 150 and formation fracture 156.

D.14—FIG. 14

Figure 14:
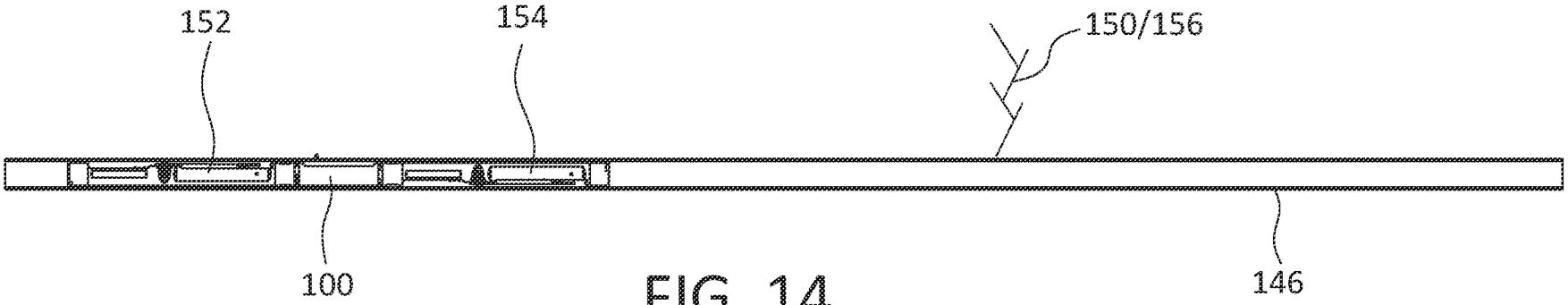
FIG. 14 is a cutaway view of a perf system and a fracture that has been created.

FIG. 14 shows an example embodiment of the perf system 100 autonomously firing a bullet, or other projectile 114, into the casing 146, or tubular member, in the wellbore.

D.15—FIG. 15

Figure 15:
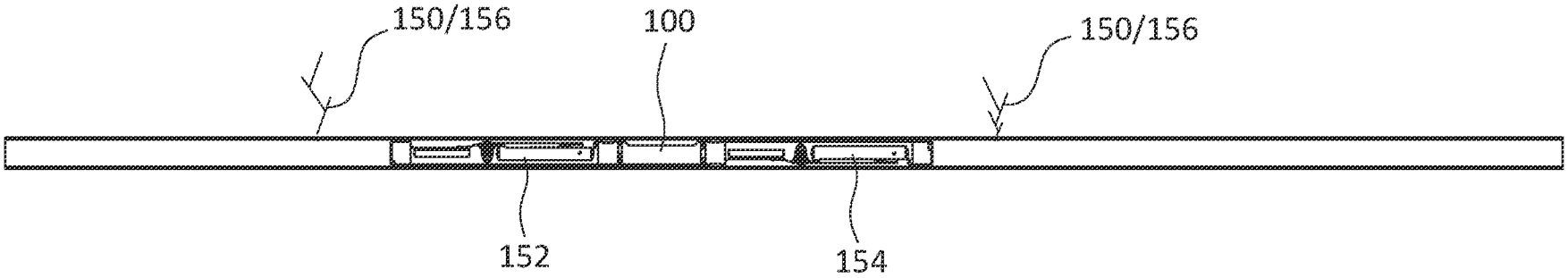
FIG. 15 is a cutaway view of a perf system and fractures that have been created at different locations.

FIG. 15 shows an example embodiment of the perf system 100 self-propelling to a location below the second perforation 150 and the formation fracture 156.

D.16—FIG. 16

Figure 16:
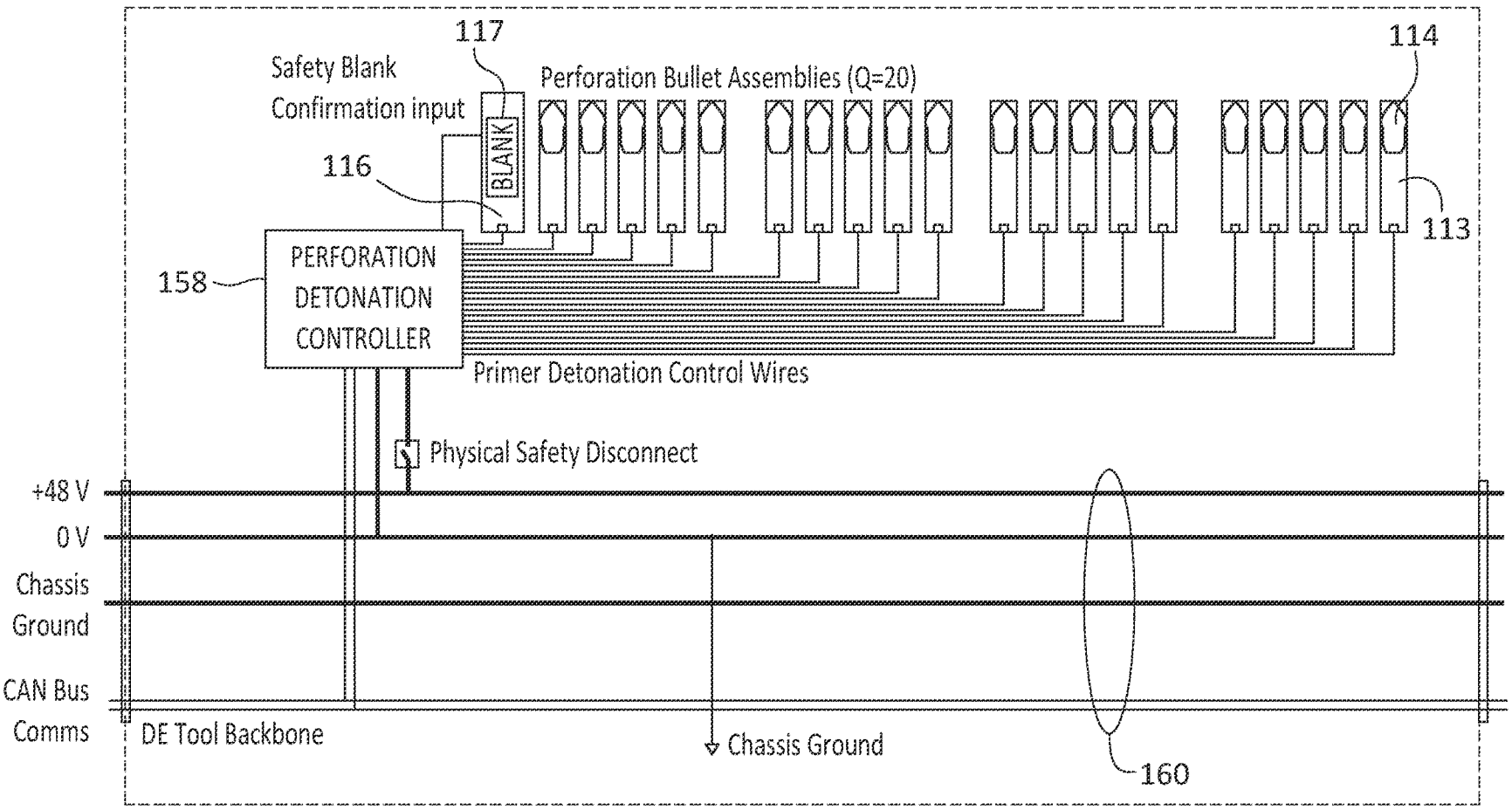
FIG. 16 is an electrical block diagram and interconnections.

The perforation system block diagram of FIG. 16 discloses further aspects of some example embodiments, including the connections from the perforation detonation controller (PDC) 158 to the individual projectiles 114 and the safety blank 117, or simply 'blank.' The PDC 158 may also be connected to the tool network communications backbone and power bus 160. The PDC 158 may be able to select and fire any of the projectiles 114 after it has fired the safety blank 117. Firing the safety blank 117 may break the verification wire which is an input back to the PDC 158. The PDC 158 senses, such as with an accelerometer for example, that the safety blank 117 has been fired which is recognized as a permissive to allow firing of any of the projectiles 114.

Each perforation projectile assembly may have a wire, which when connected to a flow of current, AC or DC, may ignite the propellant to fire the projectile. The PDC 158 may receive a specific message from the network communication backbone 160. The first message may fire the safety blank 117. This action may enable subsequent messages to the PDC 158 to fire a single projectile, either in a predefined order, or specific bullet position.

Figure 2:
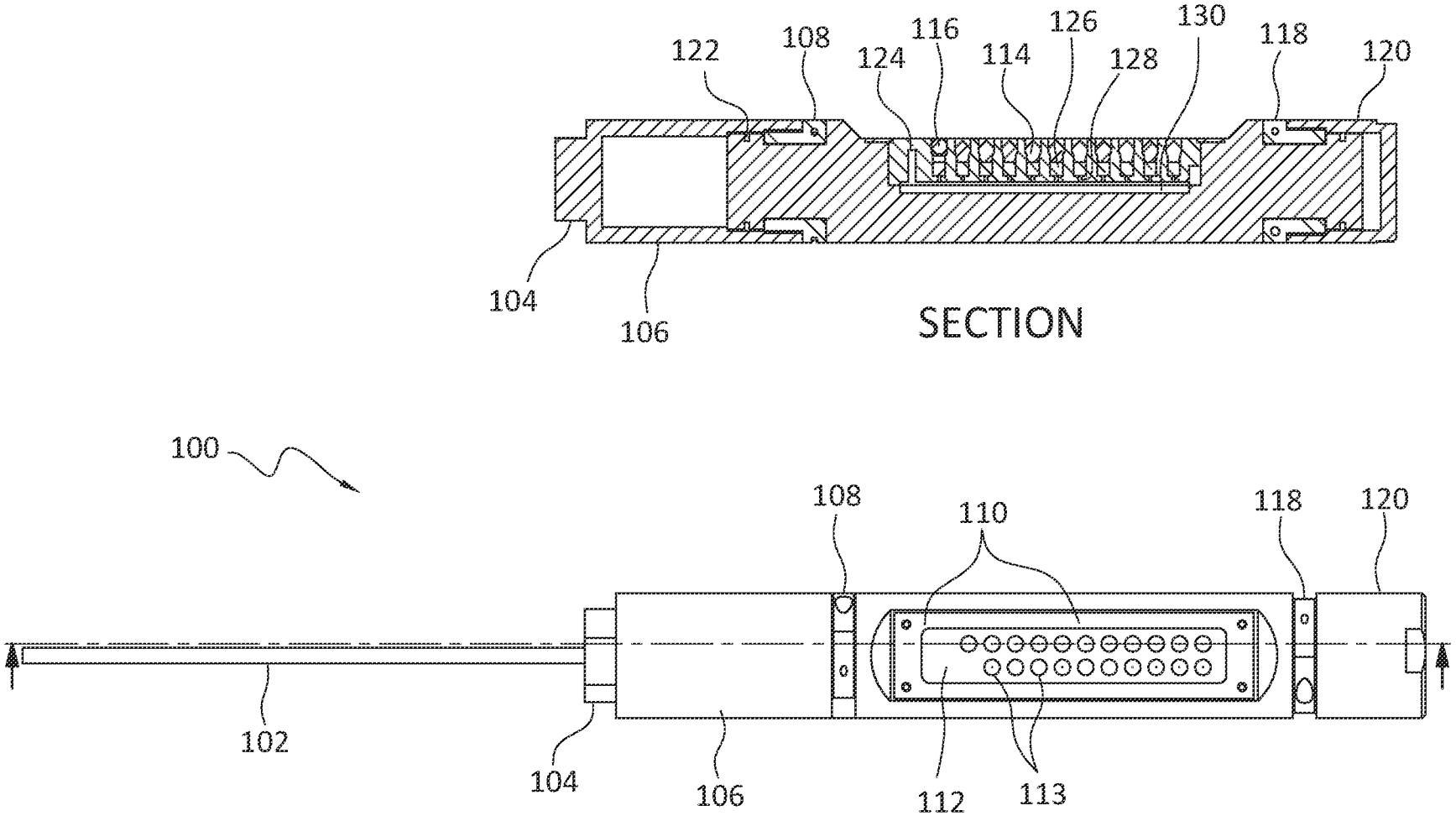
FIG. 2 is a first cross section view of a perf system (tethered).
Figure 3:
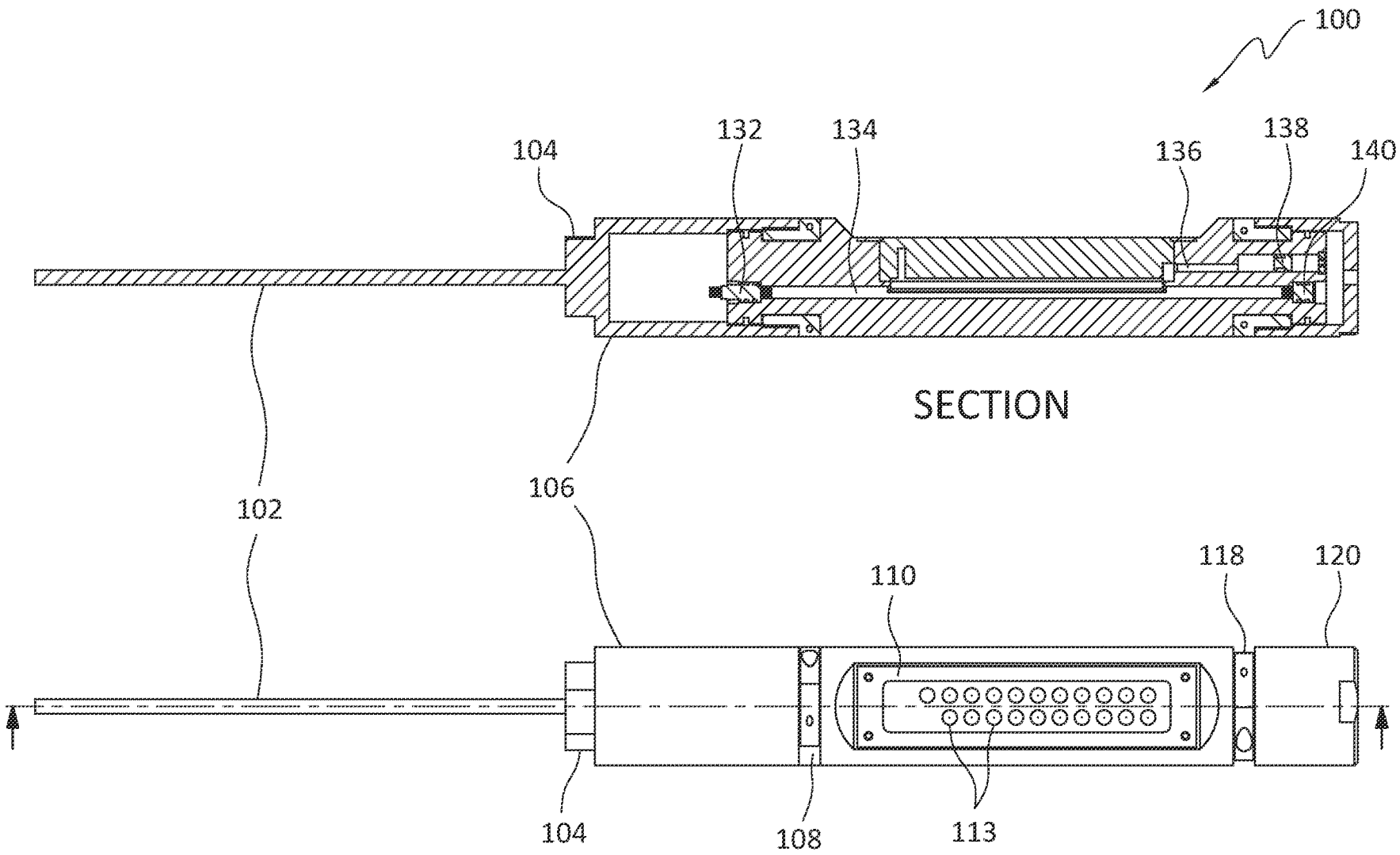
FIG. 3 is a second cross section view of a perf system (tethered).

The PDC 158 may be housed in a board enclosure. All bullet chambers 113 may be capped with a sealant, as shown in FIG. 2 for example (retaining cap 110). Similarly, the wiring and PDC 158 may be potted in sealant to make the entire unit waterproof at high pressures. The PDC 158 may also have a physical safety disconnect to disconnect power from the perf system 100.

With continued reference to FIG. 16, and directing attention now to FIGS. 16*a*, 16*b*, and 16*c*, some example commands that may be used in the operation of an example perf system are disclosed.

D.17—FIG. 17

FIGS. 17-21 disclose example configurations of a perf system configured and operable to implement a process of perforating and hydraulically frac'ing a wellbore while maintaining a tethered connection and staying in the wellbore during the frac. This type of frac'ing operation is a low flow rate frac. That may require significantly less equipment on the surface and may significantly lower the carbon footprint that conventional operations create. Operation according to an embodiment may enable completely off-the-grid power to frac a wellbore. Following the discussion of FIGS. 17-21 is a discussion of an example method that may be performed by a perf assembly according to any one or more of FIGS. 17-21.

Figure 17:
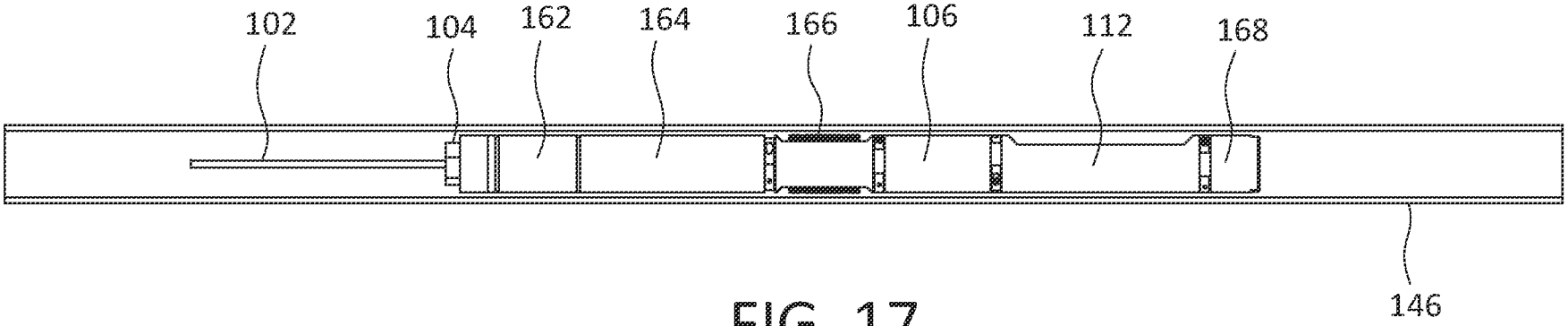
FIG. 17 discloses an example assembled perf system with a sealing and isolation module.

As shown in FIG. 17, an example perf assembly 100 may comprise various components. One such component is a tether 102. A tethered connection may comprise a wireline, e-line, or fiber optic. The tether 102 may enable transmission/reception of power, power, signals, and commands, to/from the surface from the system downhole, or from the system downhole to the surface.

A perf system 100 may also comprise a connection device 104. The connection device 104 may comprise a cable head connection which may be coupled to the perf system 100.

A sealing and isolation module 162 may be provided in the perf system 100, and may comprise, for example, a pack or plugging device that may isolate areas of the wellbore to create a pressure differential. The sealing element may be actuated by mechanical, electrical, or hydraulic power.

A hydraulic power unit (HPU) 164 may be provided that may comprise, and house, an accumulator or compensator, multiple hydraulic pumps, and electrical wiring that may transmit power and or commands throughout the tool. The hydraulic pump may actuate the sealing and isolation module, and/or the slips 166. The slips 166 may be used to selectively grab, or otherwise engage, the casing or tubular member in the wellbore. This may enable the perf system 100, and other systems and components, to be held in place in the wellbore while the pressure differential increases across the system. The slips 166 may be actuated by a hydraulic pump, for example.

As noted earlier herein, the perf system 100 may comprise a controls housing 106. The controls housing 106 may house one or more PCBs, master control units, CPUs, or modems. The control stored in the controls housing 106 may receive and send data, or signals, from/to the perf system 100 and/or back to the surface during operation. Further, the controls housing 106 may contain a pressure sensor, temperature, sensors, accelerometers, or an optical device or sensor that may record internal and or external data.

An example embodiment of a perf system 100 may comprise a block chamber 112 system as in the example disclosed in FIGS. 1-21, or a self-loading system as in the example disclosed in FIGS. 22-31.

Finally, a perf system 100 may comprise a sensor sub 168. In an embodiment, the sensor sub 168 may comprise, for example, a pressure sensor, temperature sensor, and accelerometer.

D.18—FIG. 18

Figure 18:
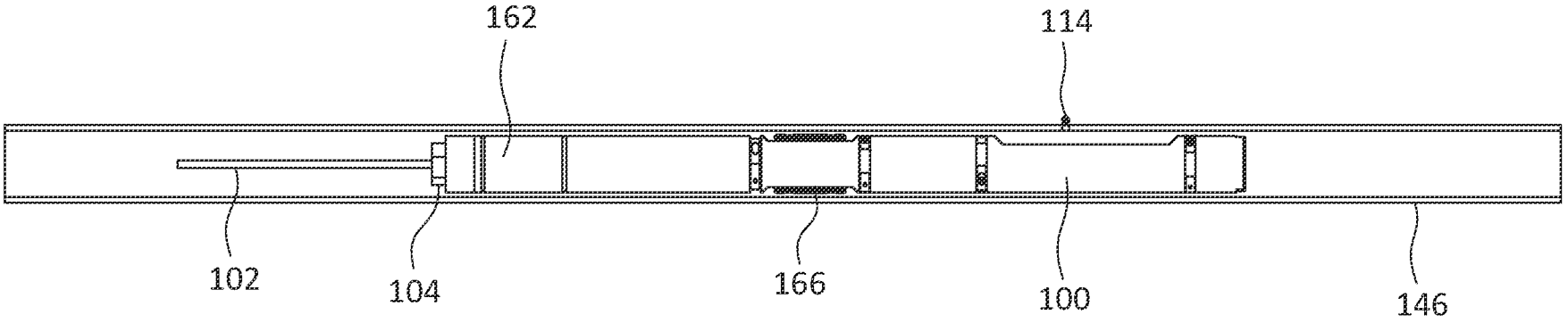
FIG. 18 discloses an assembled perf system with a sealing and isolation module and firing a bullet to create a perforation.

FIG. 18 discloses an example embodiment of the perf system 100 firing a bullet into a casing and creating a perforation. The command to fire the projectile 114 from the block chamber may be sent to the perf system 100 from the surface through the tether 102.

D.19—FIG. 19

Figure 19:
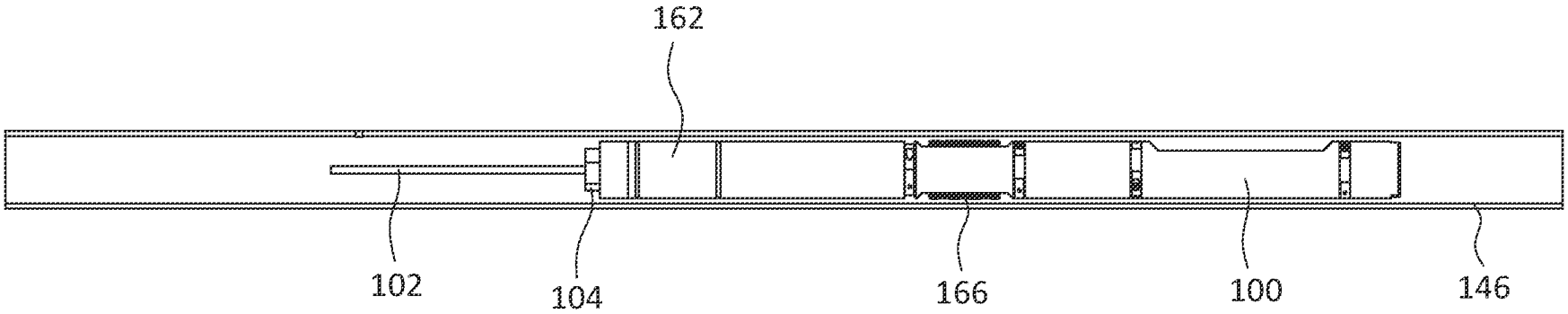
FIG. 19 discloses an assembled perf system with a sealing and isolation module and being pumped past the perforation(s).

FIG. 19 discloses a configuration of a perf system 100 after the perf system 100 has been fired (FIG. 18). The perf system 100 may be pumped down past the perforation that was created by the perf system 100. Once the perf system 100 and assembly are pumped past the perforation, pumping may stop.

D.20—FIG. 20

Figure 20:
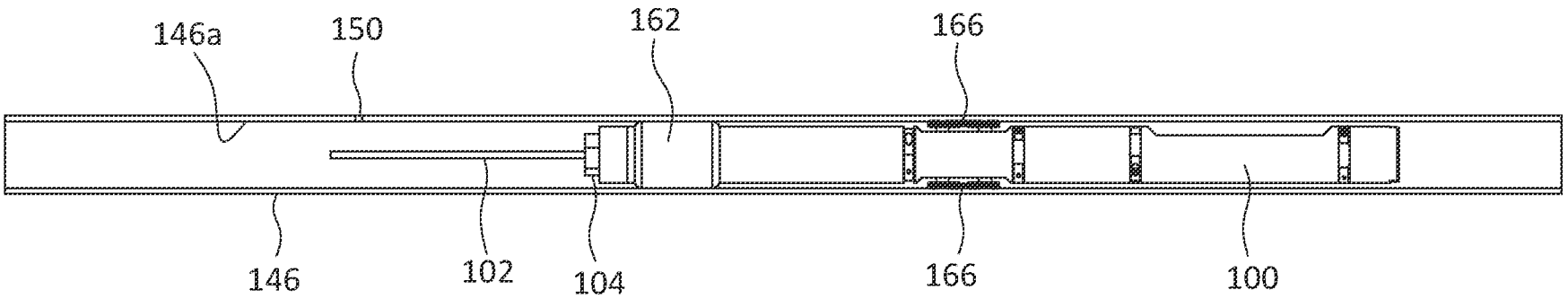
FIG. 20 discloses an assembled perf system a sealing and isolation module and setting slips and sealing the wellbore.

FIG. 20 discloses an example perf system 100 actuating a set of slips 166, which may be used to hold the perf assembly 100 in place and take on additional load, into the inside wall 146*a* of the casing 146 or tubular member in the wellbore. FIG. 20 also shows an example sealing and isolation module 162 being used to seal off the wellbore, or isolate downhole of the created perforation 150 in the casing 146.

D.21—FIG. 21

Figure 21:
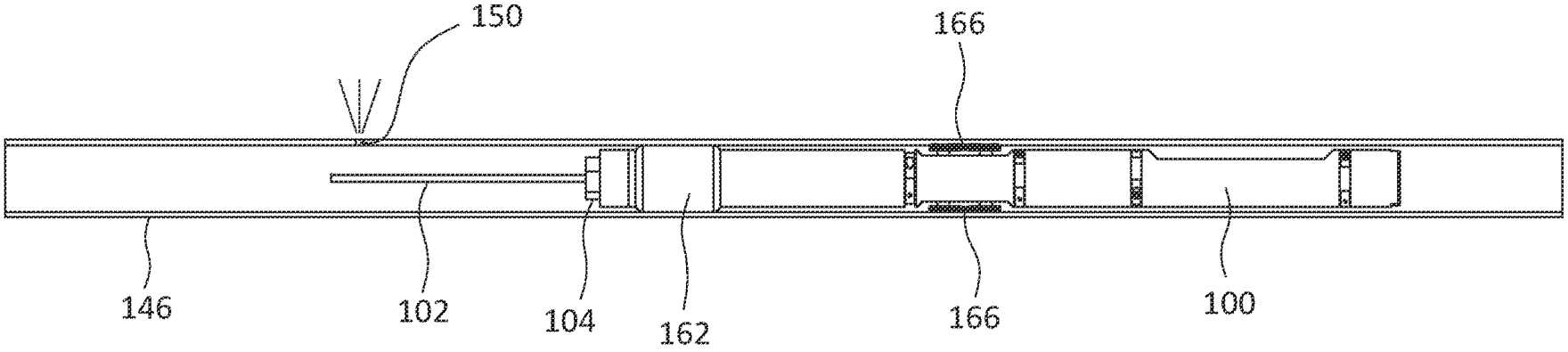
FIG. 21 discloses an assembled perf system with a sealing and isolation module and the perforation/formation being frac'd.

FIG. 21 discloses an example well formation where access to the formation is acquired by the perforation 150, that is, by being frac'd. Now that the stage has been frac'd, wireline may send a command to the perf system 100 to disengage its slips 166 from the well casing 146, and unseal the sealing element. Once the perf system 100 is no longer locked into the wellbore casing 146 by the slips 166, wireline may then pull the perf system 100 uphole to the next location where the following operations may be performed: [1] perforate the wellbore with the perf system 100; [2] pump the perf system 100 past the new perforation; [3] stop pumping and send a signal command to the perf system 100 to engage its slips 166 and seal off the wellbore; and [4] frac the stage/location. Continue to repeat [1] to [4] until the wellbore is completely perforated and frac'd. Note that the same perf system 100, specifically, the components used to store, load, and fire, the projectiles 114, may be used to completely perforate the entire wellbore.

D.21.1—Aspects of an Example Method

As noted earlier, the perf system of FIGS. 17-21, and other perf systems disclosed herein, may be used in the performance of various methods, processes, and operations. Particularly, FIGS. 17-21 disclose example configurations of an example perf system 100 configured and operable to implement a process of perforating and hydraulically frac'ing a wellbore while maintaining a tethered connection and staying in the wellbore during the frac. This type of frac'ing operation is a low flow rate frac. That may require significantly less equipment on the surface and may significantly lower the carbon footprint that conventional operations create. Operation according to an embodiment may enable completely off-the-grid power to frac a wellbore. Following is a discussion of an example method that may be performed by a perf system 100 according to any one or more of FIGS. 17-21. This method is presented only by way of example, and is not intended to limit the scope of the invention in any respect.

In an embodiment, the example method may comprise:

a. Drill wellbore using conventional drilling methods and demobilize drilling rig and equipment
b. Perform standard completion preparation work for a hydraulic fracture stimulation treatment
   i. install master valve
   ii. run cement and casing evaluation logs
   iii. pressure test wellbore and wellhead
c. Source and arrange logistical support
   i. water supply and onsite storage as needed
   ii. proppant supply and onsite storage as needed
   iii. Install conventional frac stack:
      1. redundant master valve
      2. frac head
d. Move in and rig up frac equipment
   i. max of 4 frac pump units (possibly only 2 required), chemicals, blender, and control van/skid
   ii. option—fully remote control of pumping operations
   iii. note that typical frac is 90 BPM in ND with 14-16 pumps and could easily do 4 wells at the same time with embodiments of the disclosed methods, but may have to add 1 blender for each well, but could be a much smaller blender like those used for cementing e. Move in and rig up wireline equipment
   i. wireline unit (single conductor), crane, pressure control, cable head, weight bars if needed, and casing collar locater (ccl)
   ii. install pressure control for pump-down wireline configuration:
      1. defiant blast tube (protect cable)
      2. wireline bop (blow out preventer)
      3. tool trap (optional)
      4. conventional lubricator—length of wl tool string
      5. grease head and/or pack-off
f. Install LiDAR cable health (diameter) monitoring and continuously monitor cable for wear, such as by checking the outside diameter of the cable, as it is pulled from the well
g. Rig Up the perf system and plug equipment
   i. Example tool string top to bottom:
      1. cable head (top)
      2. ccl (casing collar locator)
      3. pressure sensor (high pressure side)
      4. plug (plug and hydraulic unit)
      5. pressure sensor (low pressure side)—communicate with each other to identify pressure differentials when a seal is isolating the wellbore, such as a pressure differential between the pressures above/below the seal.
      6. perf system
      7. LiDAR system (bottom).
h. Run In hole with tool string to maximum depth using pump-down method, shut-down pump
i. Pull up hole and stop at first perforation station ($1^{st}$ cluster/stage)
j. Perforate first cluster
k. Pump again to push plug below, that is, downhole of, the perforation(s) shot. In at least some embodiments, a wellbore is perfed from the bottom (deepest specified location of the wellbore) to the top (shallowest specified location of the wellbore)
l. Set plug
m. Pump first cluster/stage frac at 15-6 BPM (for example)
   i. monitor pressure above and below the plug in real-time at the surface (through single conductor wire line, for example)
   ii. option to perform real-time fracture modeling using frac and downhole pressure data
n. Flush stage 1, reduce rate to 4-2 BPM, unset plug, flush proppant around and past the plug
o. PUH (pull up hole) to next cluster for stage 2 (12-50') and perforate
p. Slack off wireline and allow plug to move past the $2^{nd}$ perforation cluster, set plug
q. Increase rate to 15-6 BPM and continue pumping stage 2
   i. monitor pressure above and below the plug in real-time at the surface (through single conductor wire line)
   ii. option to perform real-time fracture modeling using frac and downhole pressure data
r. Flush stage 2, reduce rate to 4-2 BPM, unset plug, flush proppant around and past the plug
s. PUH to next cluster for stage 3 (12-50') and perforate
t. Slack off wireline and allow plug to move past the $3^{rd}$ perforation cluster, set plug
u. Increase rate to 15-6 BPM and continue pumping stage 3
   i. Monitor pressure above and below the plug in real-time at the surface (through single conductor WL)
   ii. Option to perform real-time fracture modeling using frac and downhole pressure data
v. Flush stage 3, reduce rate to 4-2 BPM, unset plug, flush proppant around and past the plug
w. Repeat (s through v) for 200 to 500 total stages for 10,000' lateral (7-14 days of pumping)
   i. or until reach maximum number of shoots
   ii. or plug fails to isolate (determined by monitoring pressure above and below wl)
   iii. resume pumping operation with replacement tools guns and/or plug as needed
x. Flush final stage, SD pumps, unset plug
y. Pull out of hole with tool string into lubricator
z. Close master valve on wellhead; note blast joint does not extend below the master valves to allow closing
aa. Rig down frac, lubricator, perf gun, and the frac stack equipment
bb. NU (nipple up) wellhead
cc. Flowback well through the wellhead to production facility
dd. Once the well dies, run in hole with production tubing and BHA (bottom hole assembly). When the well dies, that is, there is no longer adequate pressure in the well to push the gas/oil to the surface, an artificial lift may be put in place in the wellbore to pull oil/gas uphole.

The example method described above is not limited by the number of stages, distance traveled between stages, number of perforations created by the perf system 100, or rate of fluid being pumped. The above example method describes low rate frac'ing while maintaining a tethered connection to the surface and having a perforation system, such as the perf system 100 disclosed herein, that is reusable and is not destroyed, damaged, or and does not lose power, throughout, or below, the tool while, or after firing, a projectile 114 to perforate the wellbore.

D.22—FIG. 22

FIGS. 22-31 disclose an embodiment of an additional system that may be used in place of the block chamber design for disclosed embodiments of the perf system. The system may utilize caseless bullets that are staged in a magazine and loaded into a chamber by one or more mechanical or electrical loading devices. The system is reloadable and may fire, but is not limited to firing one projectile at a time.

Figure 22:
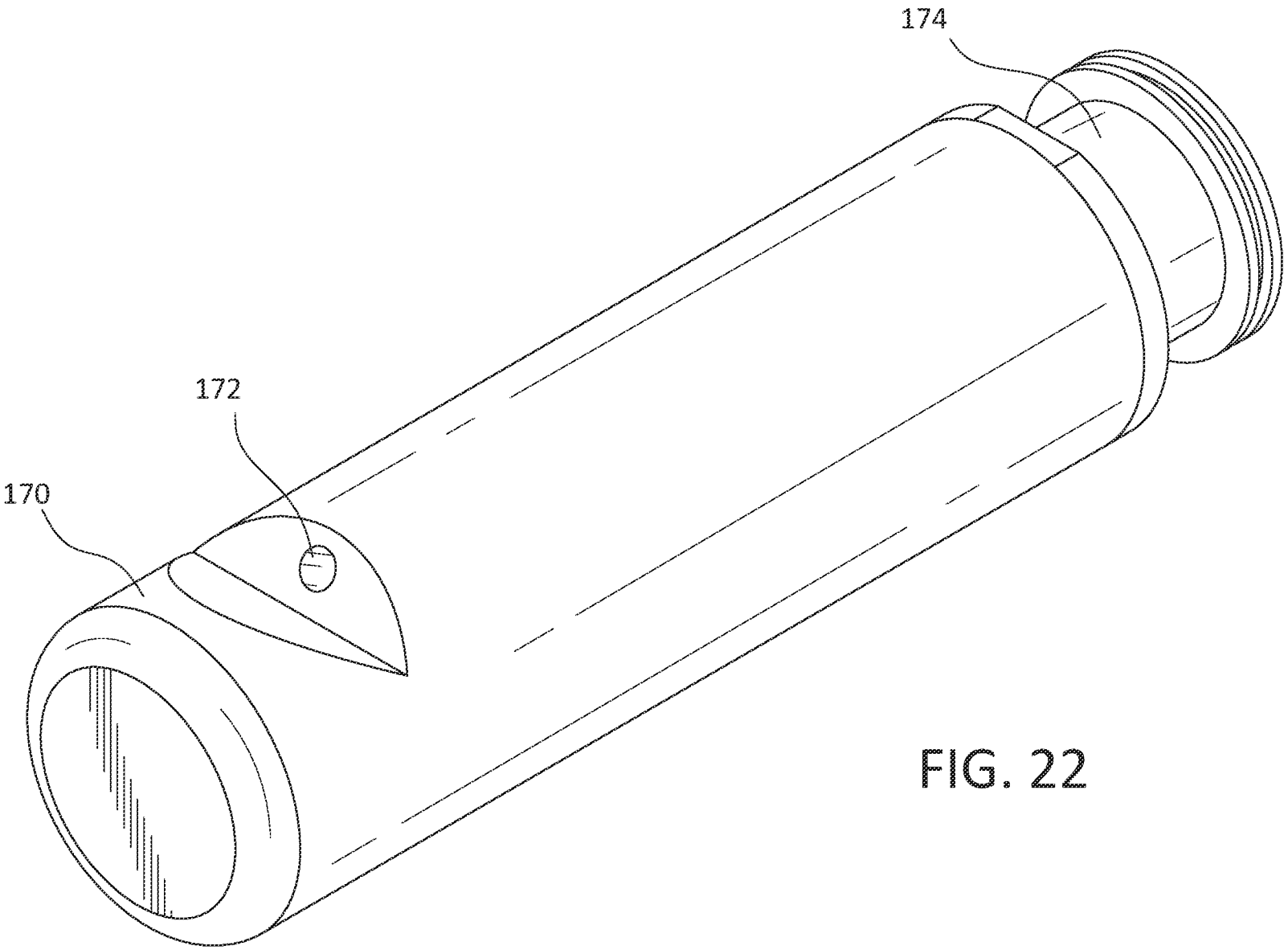
FIG. 22 discloses a sealing and isolation module.

With reference first to FIG. 22, there are disclosed various example components of a perf system 100. The first of these is a perf system body 170. In an embodiment, the perf system body 170 may be configured and operable to house the internal components that make up the perf system 100. These components may include, but are not limited to, a barrel, chamber, swing arm, firing pin, loading swivel, bullets, one or more magazines, and a spring. There may also be motors, gears, electronics, cables, or sensors included in the internals that the perf system body 170 houses and or protects. The perf system body 170 may be pressurized internally by a compensator or accumulator or allow wellbore fluid to and pressure to enter the system and allow for the internals of the perf system 100 to equalize, with regard to pressure, to the external environment.

The material used for manufacturing the perf system body 170 may comprise, but is not limited to aluminum, manganese, zinc, or other bronze alloys, nickel alloys or combinations of, but not limited to nickel with materials such as iron, chromium, copper, or molybdenum, stainless steel alloys or combinations of, but not limited to nickel, copper, or manganese, aluminum alloys or combinations of, but not limited to, zinc, copper, or iron, and other materials such as iron, titanium, polymers or plastics, carbon fiber, or tin. The perf system body 170 may be cast, machined from solid material, or 3D printed or manufactured through a process such as additive manufacturing.

As also disclosed in FIG. 22, the perf system body 170 may include a barrel 172. The barrel may be configured to enable a projectile 114 to be fired at an angle relative to a reference, where the reference may be vertical, or horizontal, for example. The barrel 172 may have any suitable length, and the barrel 172 may or may not be rifled.

Finally, the example perf body 170 of FIG. 22 may include one or more connections 174 of various types. One example connection 174 comprises a coupling connection that may couple, or connect, to other assemblies. The connection 174 interface may comprise thru ways that enable cables to travel through or electrical connectors that may be connected to the connection 174 interface.

D.23—FIG. 23

Figure 23:
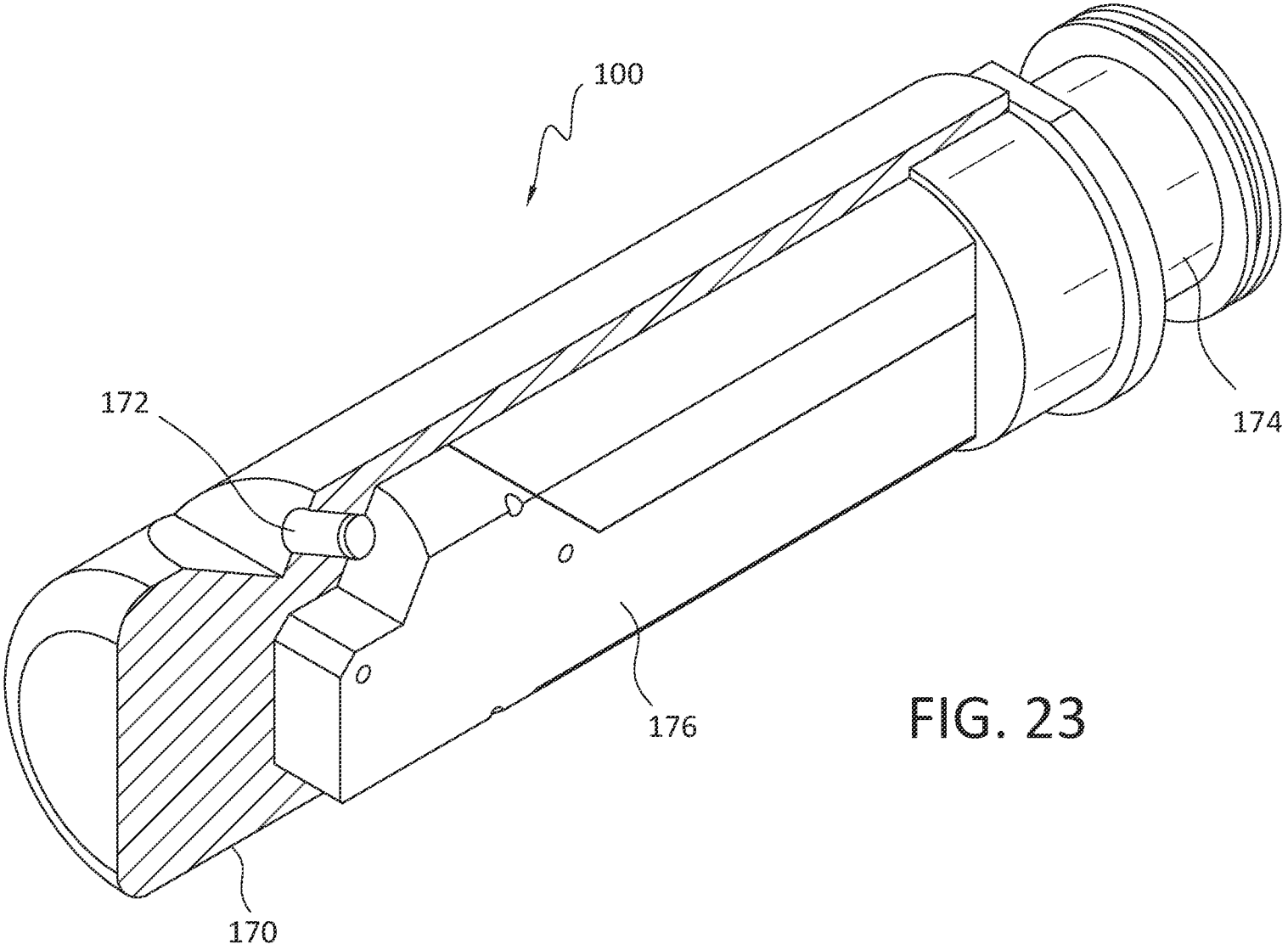
FIG. 23 is a cutaway of a single barrel downhole reloadable perforation system body.

As noted in the discussion of FIG. 22, a perf system 100 may include a barrel 172, further details of an example of which are disclosed in FIG. 23. For example, the barrel 172, which may be any suitable length, may be configured and operable to enable a projectile 114 to fire at a desired angle relative to, for example, a casing 146 in a wellbore. In an embodiment, the firing angle may be between about 30 degrees and about 90 degrees.

The perf system 100 may further include a perf system housing 176. In an embodiment, the perf system housing 176 may comprise a housing chamber that encloses all the components needed to load, fire, and reload projectiles such as bullets. The material used for manufacturing the perf system housing 176 may comprise, but is not limited to aluminum, manganese, zinc, or other bronze alloys, nickel alloys or combinations of nickel with materials such as iron, chromium, copper, or molybdenum, stainless steel alloys or combinations of, but not limited to nickel, copper, or manganese, aluminum alloys or combinations of zinc, copper, or iron, and other materials such as iron, titanium, polymers or plastics, carbon fiber, or tin. Finally, the perf system housing 176 may be cast, machined from solid material, or 3D printed or manufactured through a process such as additive manufacturing.

D.24—FIG. 24

Figure 24:
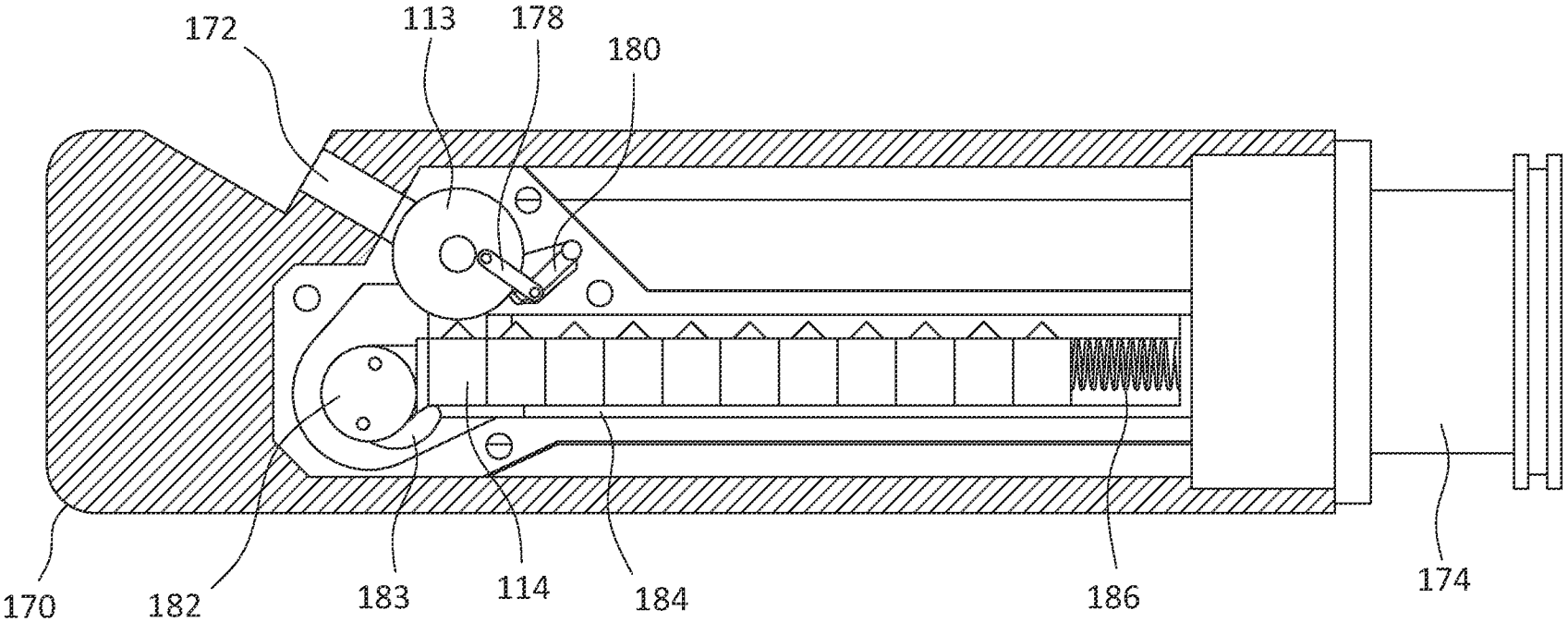
FIG. 24 is a cross section of a single barrel reloadable perforation system.

With reference now to FIG. 24, there is disclosed a cutaway view of a single barrel reloadable perforation system. As shown there, the perf system may comprise various components.

One of these components is a barrel 172. The barrel 172 may be configured to enable the perf system to fire a projectile 114 at an angle relative to structure(s) such as a well casing. The barrel 172 may have any suitable length. A chamber 113 may also be provided that comprises a mechanical and/or electrical system that may operate on a system of motion devices including gears of any type. The chamber 113 may rotate to allow the bullets to enter the chamber 113, and then rotate again to fire a projectile 114 from the chamber 113.

A swing arm 178 may also be provided that may comprise a link that may connect the chamber 113, firing pin 180, and motion devices together. The link may act to connect the motion devices and the chamber 113 to rotate the chamber 113 into the loading position, and the firing position. The link may also be connected to the firing pin 180. In the motion that may take place once the projectile 114 has entered the chamber 113, the chamber 113 may rotate to the firing position and the link may then pull the firing pin 180 into contact with the primer 128 to cause ignition of the propellant 126, and the firing of the projectile 114. The firing pin 180 may comprise a mechanical device configured and operable to exert a force on the primer 128. The firing pin 180 may be mechanically or electrically actuated.

A loading swivel 182 of the example perf system 100 may comprise a mechanical or electrical system that may operate on a system of motion devices such as gears. The loading swivel 182 may also operate on the same motion device that rotates, or activates, the chamber 113, swing arm 178, and firing pin 180. The loading swivel 182 may have a swivel arm 183 that may be connected to the loading swivel 182 that may force the projectiles 114 located in the magazine 184 into the chamber 113.

The swivel arm 183 of the loading swivel 182 may comprise, for example, a mechanical device, or arm, that may be connected to the loading swivel 182. The swivel arm 183 may be configured and operable to engage the projectiles 114 located in the magazine 184 and assist in forcing the projectile 114 into the chamber 113. The swivel arm 183 may have a device such as a spring that forces the swivel arm 183 back into position after the projectile 114 is chambered. The spring may be connected to the loading swivel 182 and the swivel arm 183.

The projectiles 114, which may comprise bullets, may comprise a caseless design that may have an electric, or mechanical, primer 128 built into the propellant 126 of the projectile 114. The projectile 114 may be configured to any shape, size, weight, or diameter and may comprise a hard material such as steel and/or tungsten for example. The projectiles 114 may be treated, such as with heat treating, and/or chemical treating, for example, to increase projectile hardness.

The magazine 184 may house the projectiles 114. The magazine 184 may not be limited to any particular number of projectiles 114 that it may house at one time, or during operation. The magazine 184 may be loaded into the perf system 100 with one or more projectiles 114 already housed inside. The magazine 184 may comprise a spring 186 that forces the projectiles 114 down the magazine 184 as projectiles 114 are loaded into the chamber 113. The magazine 184 may comprise a lip on the loading end that may prevent the projectiles 114 from continuing to eject from the magazine 184 once a projectile 114 has been loaded into the chamber 113.

D.25—FIG. 25

FIGS. 25-31 respectively disclose various example steps, or modes, in the operation of a perf system 100 according to an embodiment of the invention. The modes are indicated in the Figures in the form of changes to the mechanical configuration of the perf system 100, and the modes in this example span a range of configurations beginning with a stand-by mode and ending with a ready-to-fire mode. The sequence set forth hereafter is provided by way of illustration, and is not intended to limit the scope of the invention in any way.

Figure 25:
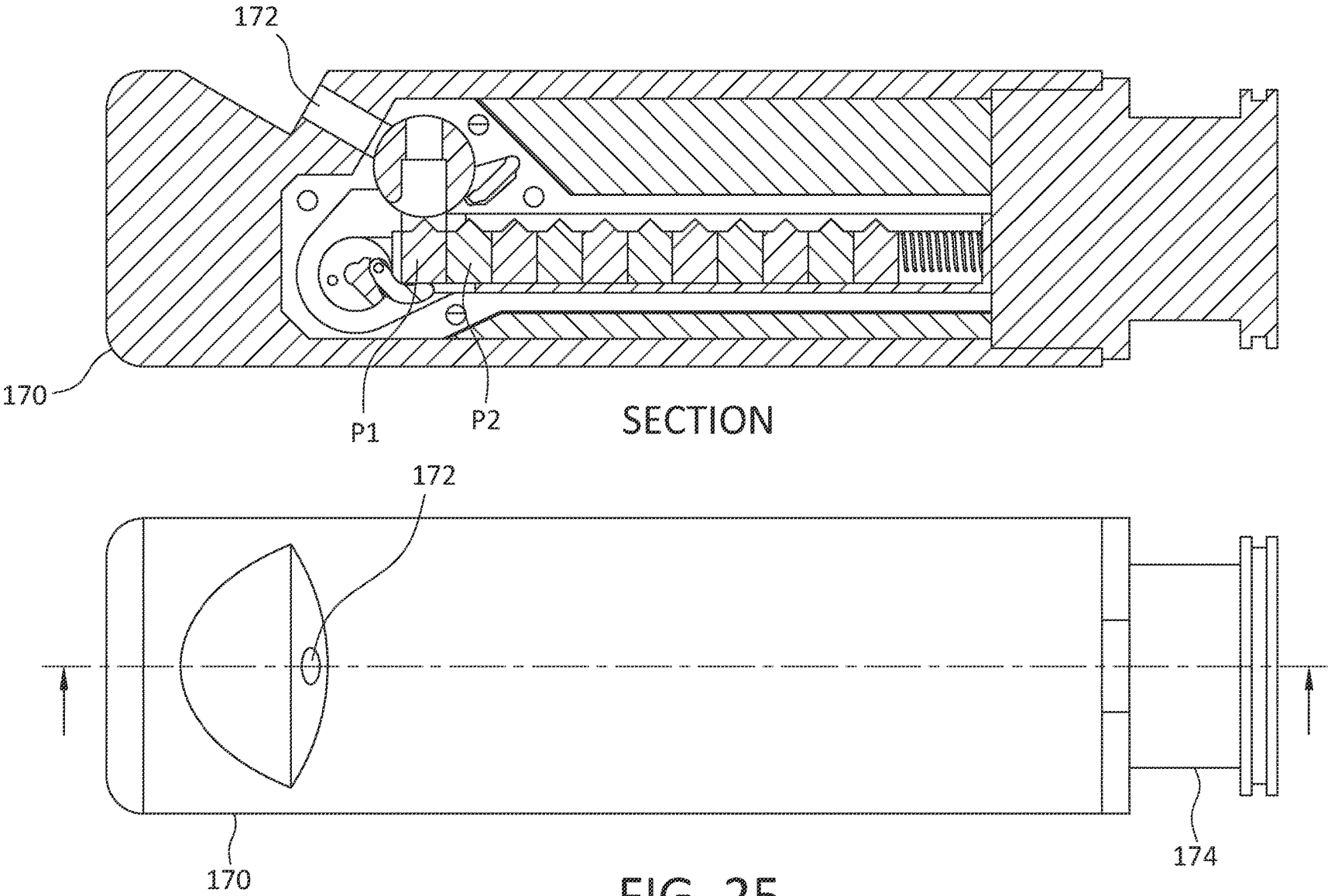
FIG. 25 is an assembly view of a single barrel reloadable perforation system.

With particular reference now to FIG. 25, there is disclosed a first step, in which the perf system 100 in a stand-by mode. Stand by mode may be defined as the state of the perf system 100 in which the loading swivel 182 and swivel arm 183 are engaged with the first projectile 114 (P1). The chamber 113 may also be in a stand-by position waiting on the loading swivel 182 and swivel arm 183 to chamber the first projectile 114 (P1). In FIG. 25, the first projectile 114 (P1) is in a ready to load position with the loading swivel 182 engaged and swivel arm 183 in contact with the projectile 114 (P1). The projectile 114 (P2) is the next projectile in the magazine 184 that will be loaded.

D.26—FIG. 26

Figure 26:
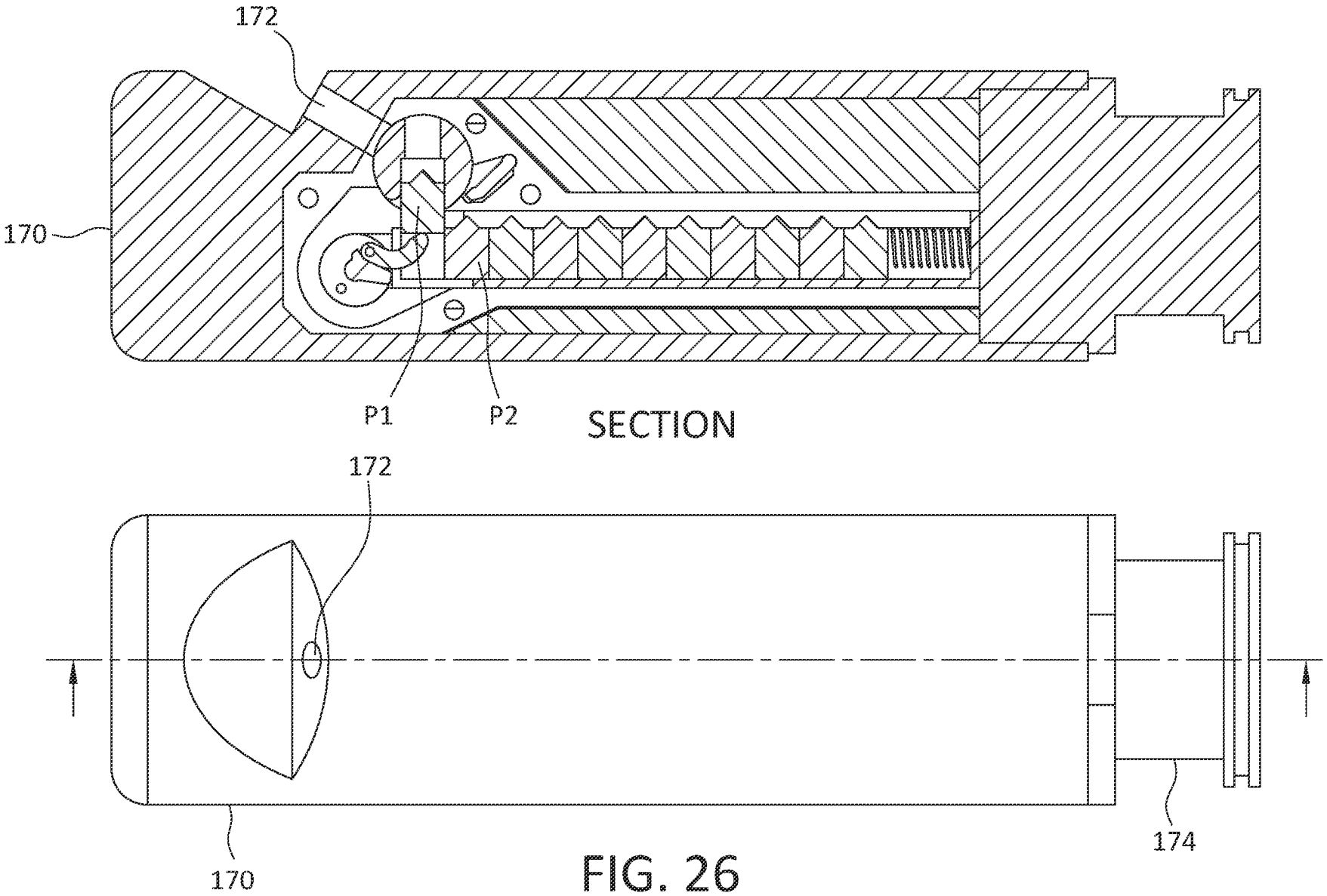
FIG. 26 depicts a stand-by position of a single barrel reloadable perforation system at step 1 of a single barrel reloadable perforation system operation.

FIG. 26 discloses an example of a second mode of the perf system 100 operation. In the mode of FIG. 26, the perf system 100 is no longer in stand-by mode and projectile 114 (P1). is being chambered. The loading swivel 182 is rotated by a motion device and the swivel arm 183 is forcing projectile 114 (P1) into the chamber 113. Thus, projectile 114 (P1) is being moved into the chamber 113, and projectile 114 (P2) is ready to move into a next position in the magazine 184.

D.27—FIG. 27

Figure 27:
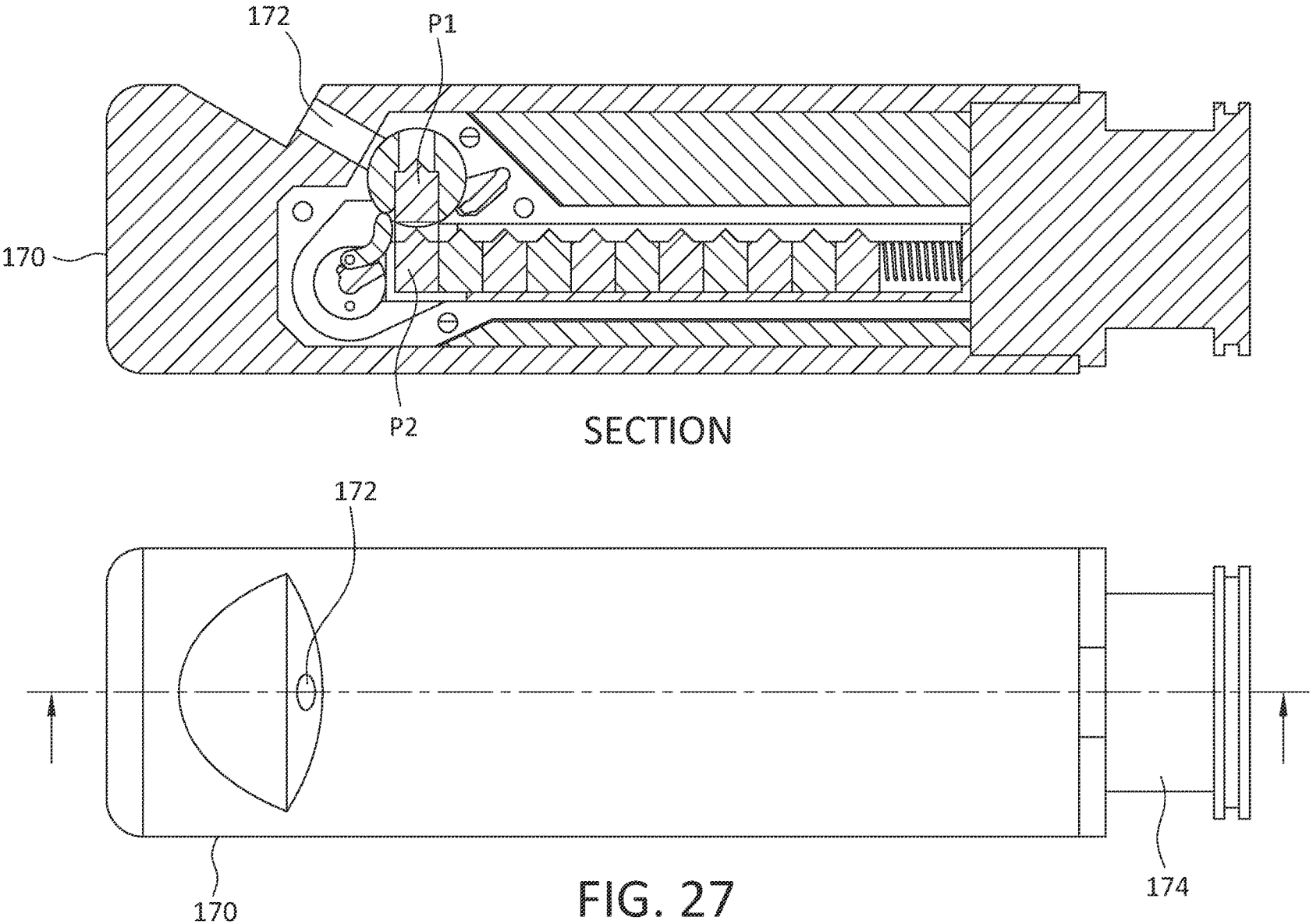
FIG. 27 discloses step 2 of a single barrel reloadable perforation system operation.

In a third mode of the perf system 100, disclosed in FIG. 27, the projectile 114 (P1) has been loaded into the chamber 113 as the loading swivel 182 continue to rotate, and the swivel arm 183 may then clear the chamber 113 and continue to rotate around. Here, projectile 114 (P1) has been loaded into the chamber, and projectile 114 (P2) is now in position to be loaded into the chamber 113. Thus, projectile 114 (P2) is now in the position that projectile 114 (P1) was in when the perf system 100 was in the second mode, shown in FIG. 26 discussed above.

D.28—FIG. 28

Figure 28:
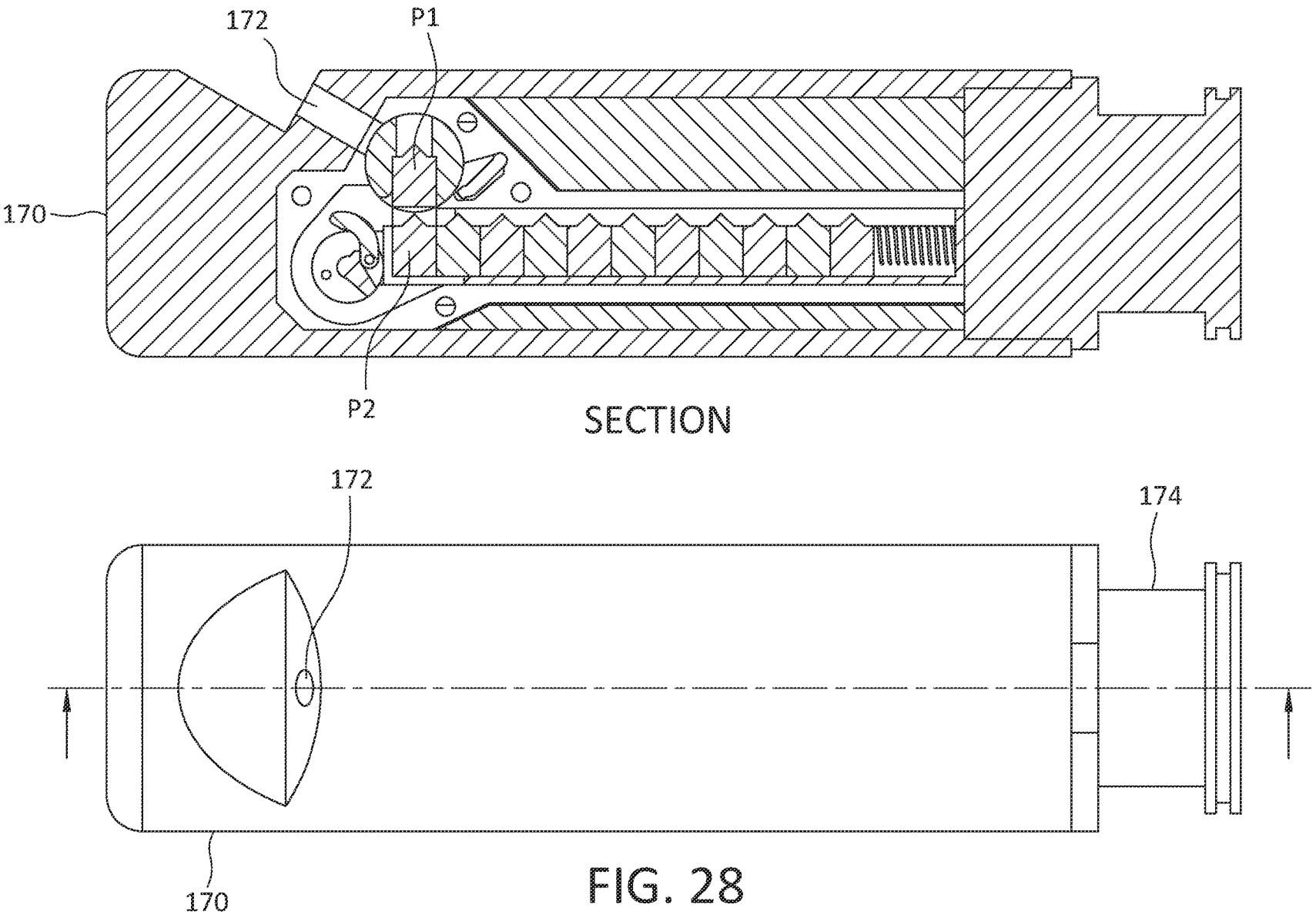
FIG. 28 discloses step 3 of a single barrel reloadable perforation system operation.

FIG. 28 discloses an example fourth mode of the perf system 100 in which, as the loading swivel 182 continues to rotate, the swivel arm 183 clears the chamber 113 and is spring loaded back into the loading position. As the motion device continues to rotate the system, the next system to begin rotating is the chamber 113. In this mode, projectile 114 (P1) has been loaded into the chamber 113, and projectile 114 (P2) is in position to be loaded, thus the projectiles 114 (P1) and (P2) are in the same disposition as in the third mode.

D.29—FIG. 29

Figure 29:
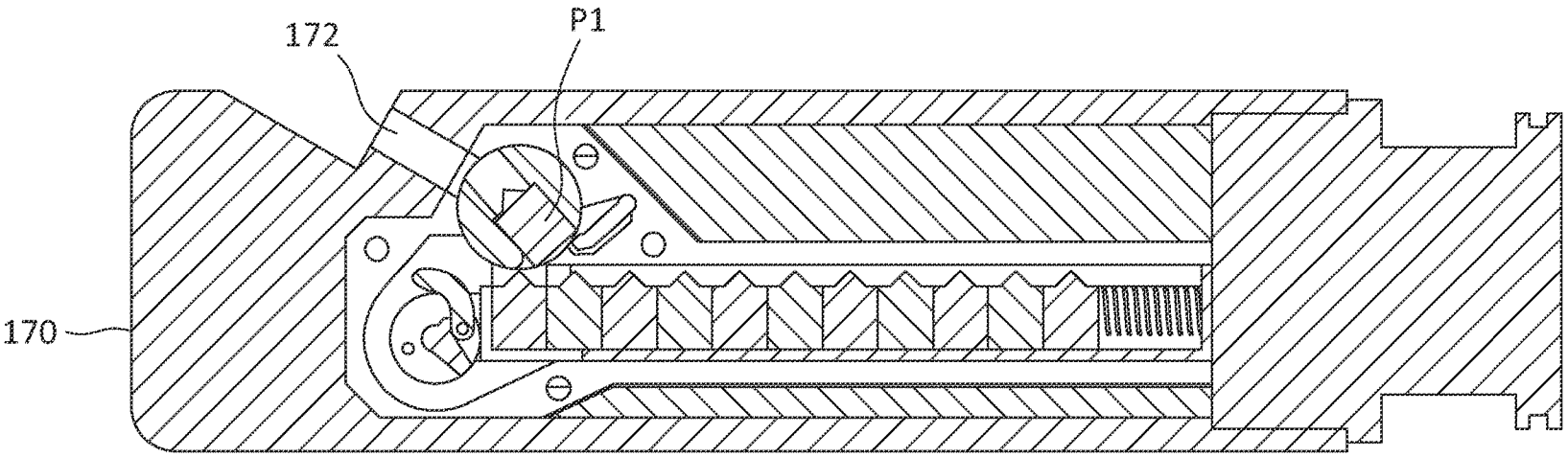
FIG. 29 discloses step 4 of a single barrel reloadable perforation system operation.
Figure 29:
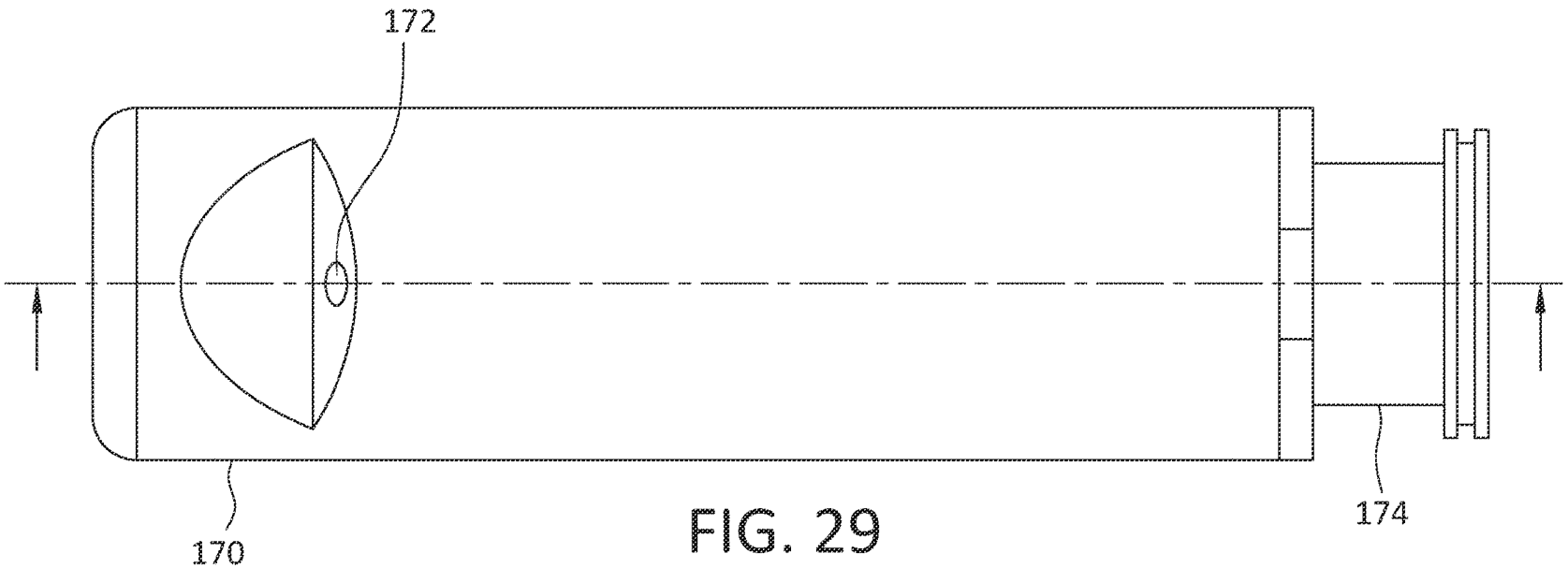
Figure 30:
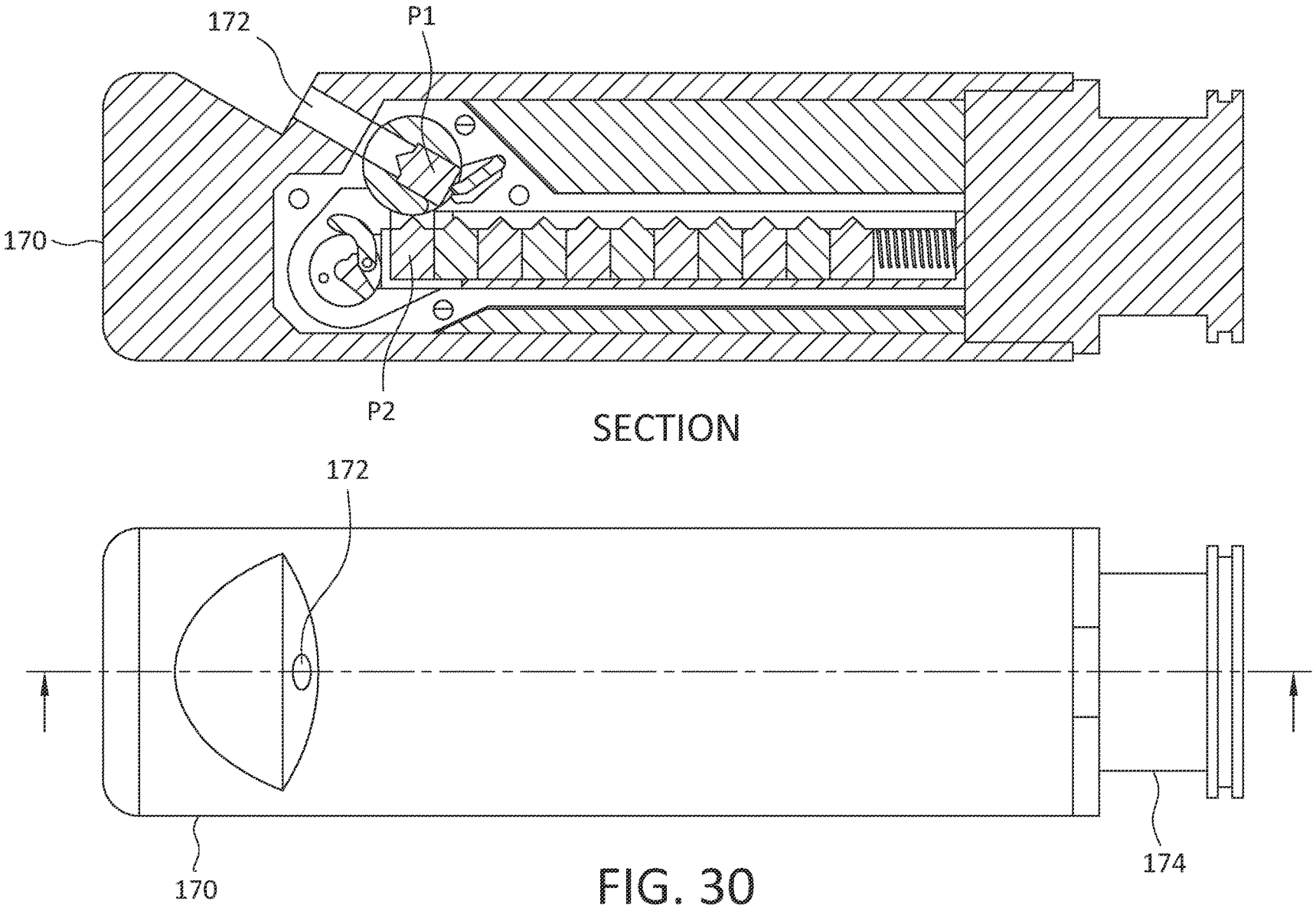
FIG. 30 discloses step 5 of a single barrel reloadable perforation system operation.
Figure 31:
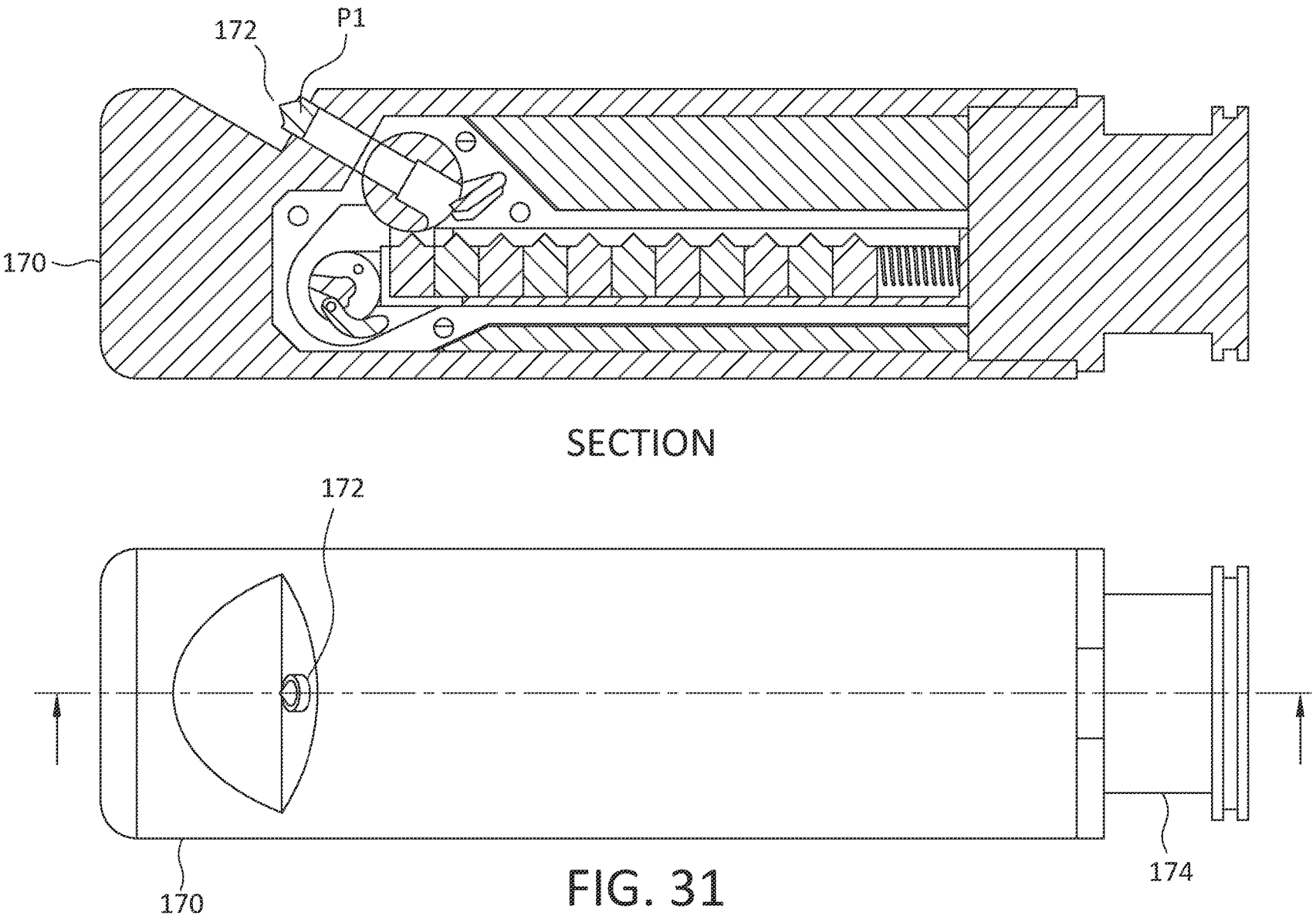
FIG. 31 discloses step 6 of a single barrel reloadable perforation system operation.

In a fifth mode of the perf system, disclosed in FIG. 29, the chamber 113 is rotating into a firing position by the motion device controlling the swing arm. Here, projectile 114 (P1) has been loaded and is moved into the firing position.

D.30—FIG. 30

In the sixth, and next to last, mode in this example, the chamber 113 is in the firing position and projectile 114 (P1) is ready to fire. The firing pin may now be triggered to impact the primer and fire the bullet. That is, bullet 1 is in a ready-to-fire position.

D.31—FIG. 31

In the final mode of this example, the firing pin has impacted the primer and the projectile 114 (P1) has been fired out of the chamber 113 and through the barrel 172. The projectile 114 (P1) will then create a perforation in the casing. The projectile 114 (P1) may not create any debris, and the chamber 113 may be empty of any bullet related materials and debris. The loading swivel 182 and swivel arm 183 are now in position to load the next projectile 114. The rotation created by the motion device will rotate the loading swivel 182 and swivel arm 183 into contact with the next projectile 114 (P2) and the chamber 113 will be reloaded back into the stand-by position.

E. EXAMPLE METHOD

Figure 32:
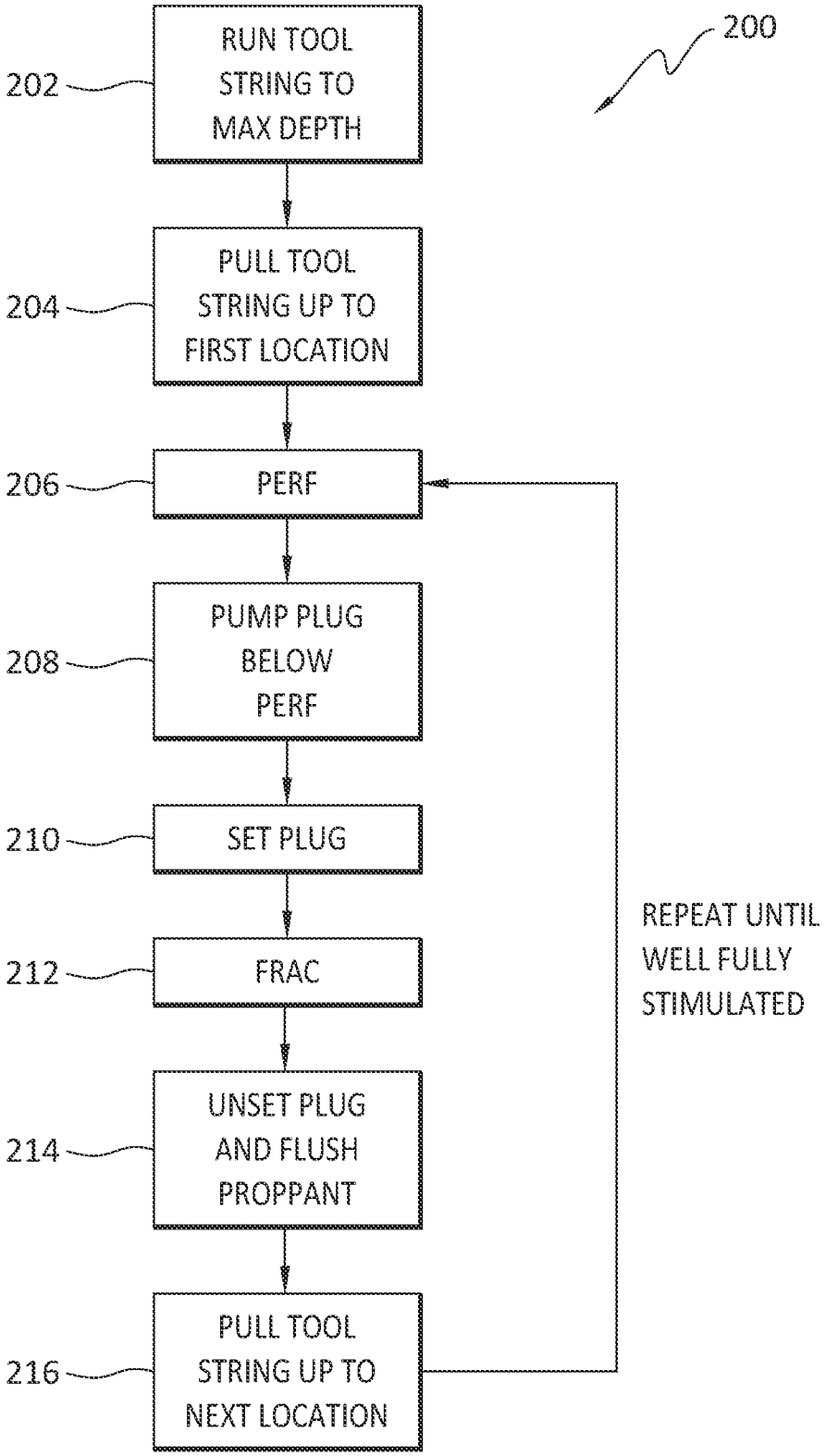
FIG. 32 discloses an example method according to one embodiment of the invention.

With attention now to FIG. 32, an example method according to one embodiment is denoted generally at 200. The example method 200 may begin when a tool string comprising a perf gun is run down 202 a wellbore to maximum depth. After reaching maximum depth, the tool string may be pulled back up hole to the first location 204 where a perforation operation may then be performed 206. Note that in an embodiment, a plug may be located above, that is, uphole of, the perf gun, when the perforation operation 204 is performed, and the perforation may be performed before the plug is set. After the perforation operation 206 is completed, a plug may be pumped down the wellbore 208 below the first perforation location.

When the plug has reached the desired location, the plug may then be set in place 210 to seal the wellbore. With the wellbore sealed below the perforation location, a frac process may then be performed 212, using a perf gun such as the perf gun 100 for example, to penetrate the casing so as to create perforations, or other openings, in the casing such that the interior of the casing is in fluid communication with the formation by way of the perforations. Because the perf gun may be reusable, the perf gun may remain downhole, and attached to wireline/tether and communication lines, during performance of the operation 204, and operations thereafter of the method 200.

After the frac is completed, the plug may be unset and proppant flushed past the plug 214. The tool string may then be pulled up hole to the next location in the wellbore 216. Then, the operations 206-214 may be repeated for that location, and for any additional locations in the wellbore where a frac is to be performed, and these processes may be repeated until the well is fully stimulated, or frac'd. Note that, in an embodiment, a single plug may be used for the entire process 200. An embodiment may be such that the plug is reusable, and can be repeatedly set and unset at various locations in the wellbore. Likewise, the perf gun may be used repeatedly in a frac operation until the well is fully stimulated, and may only be returned to the surface when/if reloading of the perf gun with projectiles is needed.

F. EXAMPLE COMPUTING DEVICES AND ASSOCIATED MEDIA

The embodiments disclosed herein (including those in Appendix A hereto) may include the use of a special purpose or general-purpose computer, including various computer hardware or software modules, as discussed in greater detail below. A computer may include a processor and computer storage media carrying instructions that, when executed by the processor and/or caused to be executed by the processor, perform any one or more of the methods disclosed herein, or any part(s) of any method disclosed.

As indicated above, embodiments within the scope of the present invention also include computer storage media, which are physical media for carrying or having computer-executable instructions or data structures stored thereon. Such computer storage media may be any available physical media that may be accessed by a general purpose or special purpose computer.

By way of example, and not limitation, such computer storage media may comprise hardware storage such as solid state disk/device (SSD), RAM, ROM, EEPROM, CD-ROM, flash memory, phase-change memory ("PCM"), or other optical disk storage, magnetic disk storage or other magnetic storage devices, or any other hardware storage devices which may be used to store program code in the form of computer-executable instructions or data structures, which may be accessed and executed by a general-purpose or special-purpose computer system to implement the disclosed functionality of the invention. Combinations of the above should also be included within the scope of computer storage media. Such media are also examples of non-transitory storage media, and non-transitory storage media also embraces cloud-based storage systems and structures, although the scope of the invention is not limited to these examples of non-transitory storage media.

Computer-executable instructions comprise, for example, instructions and data which, when executed, cause a general purpose computer, special purpose computer, or special purpose processing device to perform a certain function or group of functions. As such, some embodiments of the invention may be downloadable to one or more systems or devices, for example, from a website, mesh topology, or other source. As well, the scope of the invention embraces any hardware system or device that comprises an instance of an application that comprises the disclosed executable instructions.

Although the subject matter has been described in language specific to structural features and/or methodological acts, it is to be understood that the subject matter defined in the appended claims is not necessarily limited to the specific features or acts described above. Rather, the specific features and acts disclosed herein are disclosed as example forms of implementing the claims.

As used herein, the term 'module' or 'component' may refer to software objects or routines that execute on the computing system. The different components, modules, engines, and services described herein may be implemented as objects or processes that execute on the computing system, for example, as separate threads. While the system and methods described herein may be implemented in software, implementations in hardware or a combination of software and hardware are also possible and contemplated. In the present disclosure, a 'computing entity' may be any computing system as previously defined herein, or any module or combination of modules running on a computing system.

In at least some instances, a hardware processor is provided that is operable to carry out executable instructions for performing a method or process, such as the methods and processes disclosed herein. The hardware processor may or may not comprise an element of other hardware, such as the computing devices and systems disclosed herein.

In terms of computing environments, embodiments of the invention may be performed in client-server environments, whether network or local environments, or in any other suitable environment. Suitable operating environments for at least some embodiments of the invention include cloud computing environments where one or more of a client, server, or other machine may reside and operate in a cloud environment.

Any one or more of the entities disclosed, or implied, by Figures A-M and/or elsewhere herein, may take the form of, or include, or be implemented on, or hosted by, a physical computing device. Part, or all, of the physical computing device may comprise an element of an ALDA (Axial LiDAR Doppler Analyzer). As well, an ALDA may comprise a physical computing device, as contemplated herein.

Such a physical computing device may include a memory which may include one, some, or all, of random access memory (RAM), non-volatile random access memory (NVRAM), read-only memory (ROM), and persistent memory, one or more hardware processors, non-transitory storage media, UI (user interface) device/port, and data storage. One or more of the memory components of the physical computing device may take the form of solid-state device (SSD) storage. As well, one or more applications may be provided that comprise instructions executable by one or more hardware processors to perform any of the operations, or portions thereof, disclosed herein. Such executable instructions may take various forms including, for example, instructions executable to perform, and/or cause the performance of, any method, process, or portion of these, disclosed herein.

G. FURTHER ASPECTS AND EXAMPLE EMBODIMENTS

Following are some further example aspects and embodiments of the invention. These are presented only by way of example and are not intended to limit the scope of the invention in any way.

Embodiment 1. A downhole system, comprising: a housing configured to be releasably connected to a tether; projectile fire control circuitry disposed within the housing; a block chamber connected to the housing, and the block chamber including one or more reloadable chambers each configured to be loaded with a respective projectile; and a firing system operable to directly, or indirectly, control the firing of a projectile, in response to a command issued by the projectile fire control circuitry.

Embodiment 2. The downhole system as recited in any preceding embodiment, wherein the projectile fire control circuitry is remotely controllable.

Embodiment 3. The downhole system as recited in any preceding embodiment, wherein the housing is configured to be connected to another downhole component.

Embodiment 4. The downhole system as recited in any preceding embodiment, wherein the firing system and/or the projectile fire control circuitry are configured such that when multiple projectiles are loaded in the block chamber, the firing system and/or the projectile fire control circuitry are operable to fire the projectiles simultaneously, or in sequence.

Embodiment 5. The downhole system as recited in any preceding embodiment, wherein the firing system is operable to fire a caseless projectile.

Embodiment 6. The downhole system as recited in any preceding embodiment, wherein when the downhole system is positioned in a casing of a wellbore, the firing system is operable to fire a projectile so that the projectile creates a perforation in the casing.

Embodiment 7. The downhole system as recited in any preceding embodiment, further comprising a primer which, after causing a projectile to be fired from one of the reloadable chambers, maintains a fluid tight seal in that reloadable chamber.

Embodiment 8. The downhole system as recited in any preceding embodiment, wherein the primer is either a mechanical primer, or an electrical primer.

Embodiment 9. The downhole system as recited in any preceding embodiment, further comprising a communication line that is accessible at the surface when the downhole system is deployed downhole so as to enable data and commands to be passed between the surface and the downhole system.

Embodiment 10. The downhole system as recited in any preceding embodiment, communication between the downhole system and the surface is maintained even after one or more projectiles have been fired.

Embodiment 11. The downhole system as recited in any preceding embodiment, wherein the block chamber is reusable for multiple projectile firings.

Embodiment 12. The downhole system as recited in any preceding embodiment, wherein no cartridge or case is present, or ejected, after a projectile has been fired. Embodiment 13. The downhole system as recited in any preceding embodiment, further comprising one or more of the projectiles.

Embodiment 14. The downhole system as recited in embodiment 13, wherein one of the projectiles: is dissolvable; fragments upon impact with a wellbore casing; contains one or more nano sensors; comprises a metal alloy; comprises a combustible alloy comprising a rare earth metal; comprises a material that emits light and/or heat after firing; comprises a material with tracer, or gamma emitting alloys; is a different size and/or shape than another of the projectiles; defines an interior that houses a secondary explosive; is hermetically sealed; and/or includes a hermetically sealed primer.

Embodiment 15. The downhole system as recited in any preceding embodiment, wherein the downhole system is operable to self-pressurize the housing to balance—before, during, and after, firing the projectiles—a pressure inside the housing with a pressure in a wellbore within which the downhole system is deployed.

Embodiment 16. The downhole system as recited in any preceding embodiment, wherein the downhole system is internally powered, and is configured to operate autonomously without using any real time commands or power from any sources outside the downhole system.

Embodiment 17. The downhole system as recited in any preceding embodiment, wherein the downhole system is remotely controllable from a surface location when the downhole system is deployed downhole.

Embodiment 18. The downhole system as recited in any preceding embodiment, wherein the downhole system is deployable downhole in a string configuration that includes a sealing or isolation element, such as a plug.

Embodiment 19. The downhole system as recited in any preceding embodiment, wherein the downhole system comprises a modular element that is configured to be detachably connected to one or more other modular elements for deployment in a string to a downhole location.

Embodiment 20. The downhole system as recited in any preceding embodiment, wherein the system is configured to re-orient itself in a downhole location.

Embodiment 21. The downhole system as recited in embodiment 20, wherein the downhole system is operable to fire the projectile in any orientation, while the downhole system is deployed in a wellbore.

Embodiment 22. The downhole system as recited in embodiment 20, wherein the downhole system is hermetically sealed against the ingress of foreign matter while the downhole system is deployed in a wellbore.

Embodiment 23. The downhole system as recited in embodiment 20, wherein the downhole system is configured to remain in a wellbore before, during, and after the frac, while at the same time retaining mechanical and electrical functionality during, and after, the frac.

Embodiment 24. A method for using the downhole system of any of embodiments 1-23.

Embodiment 25. A method comprising: performing a frac'ing process using the downhole system of any of embodiments 1-23.

Embodiment 26. A method according to any of the disclosed embodiments.

Embodiment 27. A method, comprising: performing a downhole operation using a downhole system.

Embodiment 28. The method as recited in embodiment 27, wherein the downhole system comprises a perf system, and the downhole operation comprises firing a perf charge.

Embodiment 29. The method as recited in embodiment 27, wherein except for projectiles and primers used by the downhole system, the downhole system is reusable for one or more additional downhole operations, without requiring retraction of the downhole system to a surface location for reloading.

Embodiment 30. The method as recited in embodiment 27, wherein the downhole operation does not leave any frac'ing debris in a downhole operating environment where the downhole operation is performed.

Embodiment 31. The method as recited in embodiment 27, wherein the downhole operation comprises firing one or more perf charges in series, or simultaneously.

Embodiment 32. The method as recited in embodiment 27, wherein the downhole operation comprises a frac'ing operation, and mechanical and electrical functionality of the downhole system is maintained during, and after, the frac.

Embodiment 33. The method as recited in embodiment 27, wherein the downhole operation comprises firing a perf charge with the downhole system and, after the perf charge has been fired, receiving a command from a surface location and, in response to the command, firing another perf charge with the downhole system.

Embodiment 34. The method as recited in embodiment 27, wherein the downhole operation comprises pumping a perf system to a downhole, or sub-surface, location.

Embodiment 35. The method as recited in embodiment 27, wherein the downhole system autonomously performs the downhole operation.

Embodiment 36. The method as recited in embodiment 27, wherein the downhole operation comprises firing a perf charge with the downhole system, automatically reloading the downhole system, and firing another perf charge after the reloading.

Embodiment 37. The method as recited in embodiment 27, wherein the downhole operation comprises firing a blank perf charge with the downhole system and, only after the blank perf charge has been fired, firing, with the downhole system, a live perf charge that uses a projectile.

Embodiment 38. The method as recited in embodiment 27, further comprising unsetting a plug, and then pumping fluid past the unset plug to flush out remaining proppant.

Embodiment 39. The method as recited in embodiment 27, wherein the downhole operation comprises a frac'ing operation performed using a perf gun, and during at least part of the frac'ing operation, a resettable plug is positioned above the perf gun.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method, comprising:

running a downhole system into a downhole environment that comprises a wellbore, and the downhole system is configured such that a reusable plug of the downhole system is positioned uphole of a perforation gun of the downhole system; and with the perforation gun, perforating a casing at a stage of the wellbore, and the perforating is performed using a projectile, wherein the perforating is performed by firing the projectile from a chamber of the perforation gun.

2. The method as recited in claim 1, wherein the reusable plug is set in the wellbore before the perforating of the casing is performed.

3. The method as recited in claim 1, wherein the perforating of the casing is performed before the reusable plug is set in the wellbore.

4. The method as recited in claim 1, wherein after the perforating is performed, the reusable plug is moved to another stage of the wellbore.

5. The method as recited in claim 1, wherein an axial LiDAR doppler analyzer component of the downhole system is used to monitor a portion of the downhole system and/or conditions in the wellbore.

6. The method as recited in claim 1, wherein after the perforating is performed, the downhole system is pumped down to a location where the reusable plug is located downhole of the first stage of the wellbore.

7. The method as recited in claim 1, wherein the reusable plug is set at the stage of the wellbore, and subsequently unset, and after the reusable plug is unset, proppant is flushed around and past the reusable plug.

8. The method as recited in claim 7, wherein after the proppant is flushed, pumping fluid is used to remove proppant remaining on the reusable plug.

9. The method as recited in claim 1, wherein running the downhole system into the downhole environment comprises pumping the downhole system down the wellbore using a pumping fluid.

10. The method as recited in claim 9, wherein after the perforating is performed, the downhole system is pumped down to another stage in the wellbore that is below the first stage.

11. The method as recited in claim 9, wherein after the perforating is performed, the downhole system is pumped down to another stage in the wellbore that is above the first stage.

12. The method as recited in claim 1, wherein a safety blank is fired from the perforation gun before the perforating is performed.

13. The method as recited in claim 1, wherein after the perforating is performed, and while the perforation gun remains in the wellbore, the perforation gun reloads itself with another projectile for a subsequent perforating operation at another stage of the wellbore.

14. The method as recited in claim 1, wherein the projectile comprises a caseless projectile.

15. The method as recited in claim 1, wherein communication between the downhole system and a surface location is maintained even after the projectile h as been fired.

16. The method as recited in claim 1, wherein the downhole system is moved between locations in the wellbore using a tether or tractor.

17. The method as recited in claim 1, further comprising monitoring pressure above and/or below the reusable plug.

18. The method as recited in claim 1, wherein the perforating comprises performing one or more additional projectiles in response to a command, received from a user, that specifies a firing order for the one or more additional projectiles.

19. The method as recited in claim 1, wherein the downhole system operates autonomously with respect to its movements and operations within the wellbore.

20. The method as recited in claim 1, wherein firing the projectile comprises igniting a propellant using a filament ignitor apparatus.

21. A method, comprising:

running a downhole system into a downhole environment that comprises a wellbore, and the downhole system is configured such that a reusable plug of the downhole system is positioned uphole of a perforation gun of the downhole system; and with the perforation gun, and while the perforation gun remains in the wellbore, loading the perforation gun with a projectile.

22. The method as recited in claim 21, wherein after the projectile is loaded, a perforating operation is performed at a stage in the wellbore, and the perforating operation comprises firing the projectile from a chamber of the perforation gun.

23. The method as recited in claim 22, wherein the projectile is a caseless projectile.

24. The method as recited in claim 22, wherein after a perforating operation is performed using the projectile, and while the perforation gun remains in the wellbore, the perforation gun reloads the chamber with another projectile.

25. The method as recited in claim 22, wherein the perforating operation is performed with the reusable plug in an unset state.

26. The method as recited in claim 22, wherein the perforating operation is performed while the reusable plug is set in the wellbore.

27. The method as recited in claim 22, wherein a safety blank is fired from the perforation gun before the perforating is performed.

28. The method as recited in claim 21, wherein after the reusable plug is set, a check is performed, using an uphole side pressure sensor of the downhole system and a downhole side pressure sensor of the downhole system, to determine if a pressure differential is present across the reusable plug.

29. The method as recited in claim 28, wherein, while remaining downhole, the reusable plug is set at multiple different stages of the wellbore, and the downhole system is part of a toolstring that remains attached to a wireline/tether while the reusable plug is being set, and unset, at the different stages.

30. The method as recited in claim 21, wherein a command sequence used to control operation of the perforation gun comprises:

receiving, and responding to, by the perforation gun a status query;

receiving, by the perforation gun, an arming command and, in response to the arming command, arming the perforation gun;

firing, by the perforation gun, a blank, and confirming the firing of the blank;

firing, by the perforation gun, the projectile; and receiving, by the perforation gun, a disarm command and, in response to the disarm command, disarming the perforation gun, and reporting the disarming.

31. The method as recited in claim 30, wherein the commands and responses are transmitted between the perforation gun, and a master control unit at a surface location, by way of a communication line that connects the perforation gun to the master control unit.

32. The method as recited in claim 21, wherein the downhole system is run down to the downhole location using a tether.

* * * * *